US007201526B2

(12) United States Patent
Tani

(10) Patent No.: US 7,201,526 B2
(45) Date of Patent: Apr. 10, 2007

(54) EXTRUDING CONTAINER OF APPLYING FILLER

(75) Inventor: Yoshikazu Tani, Tokyo (JP)

(73) Assignee: Tokiwa Corporation, Gifu (JP)

( * ) Notice: Subject to any disclaimer, the term of this patent is extended or adjusted under 35 U.S.C. 154(b) by 0 days.

(21) Appl. No.: 11/454,946

(22) Filed: Jun. 19, 2006

(65) Prior Publication Data

US 2006/0263140 A1 Nov. 23, 2006

Related U.S. Application Data

(63) Continuation-in-part of application No. 10/551,444, filed as application No. PCT/JP05/13519 on Jul. 15, 2005.

(51) Int. Cl.
*B05C 11/00* (2006.01)

(52) U.S. Cl. ..... 401/266; 401/172; 401/176; 222/390

(58) Field of Classification Search ..... 401/65, 401/68, 74, 80, 82, 171–174, 176, 179, 180, 401/182, 266, 277; 222/390, 391
See application file for complete search history.

(56) References Cited

U.S. PATENT DOCUMENTS 6,474,891 B1 * 11/2002 Liu ..... 401/174
6,793,431 B1 * 9/2004 Tsai ..... 401/172
6,811,062 B2 * 11/2004 Tani ..... 222/390

FOREIGN PATENT DOCUMENTS

JP 6-21515 3/1994
JP 2004-089687 3/2004

* cited by examiner

*Primary Examiner*—Huyen Le
(74) *Attorney, Agent, or Firm*—Bacon & Thomas, PLLC

(57) ABSTRACT

A user-friendly extruding container of applying filler is structured such that, when an operating tube 3 and a main body tube 2 are relatively rotated in one direction, a movable body 6 moves forward by an engagement portion constituted by a female thread 4*c* and a male thread 6*b* and the rotation preventing portion constituted by an engagement portion 6*e* of the movable body 6 and an engagement portion 3*d* of the operating tube 3 to extrude applying filler for application with giving click feeling by the click mechanism 11 constituted by a tubular click spring member with the click tooth 12*a* and the compression spring portion 12*b* between the tubular body 4 and the operating tube 3 and, when rotated in the reverse direction, the movable body 6 moves backward with giving click feeling, whereby a user can perceive forward movement and returning of the movable body 6.

3 Claims, 26 Drawing Sheets

EXTRUDING CONTAINER OF APPLYING FILLER

This application is a continuation-in-part application of U.S. patent application Ser. No. 10/551,444, filed Sep. 29, 2005, the entire disclosure of which is herein incorporated by reference.

TECHNICAL FIELD

The present invention relates to an extruding container of an applying filler for extruding the applying filler so as to apply.

BACKGROUND ART

In conventional, as a movable body feeding apparatus provided for use by extruding an applying filler, for example, a liquid filler installed in a container, there has been known a movable body feeding apparatus which is provided with a main body tube in which a filling region where an applying filler is filled is provided in an inner portion, and an operating tube provided in a rear end portion of the main body tube so as to be relatively rotatable, and is structured such that when the main body tube and the operating tube are relatively rotated, the main body tube and a movable body received within the operating tube move forward, and the applying filler is extruded to a leading end side on the basis of a forward movement of a piston provided in a leading end of the movable body, whereby it is possible to apply the applying filler to a portion to be applied through an opening of a discharge cover attached to the leading end of the main body tube (for example, refer to Japanese Unexamined Patent Publication No. 2004-89687

DISCLOSURE OF THE INVENTION

Problem to be Solved by the Invention

In this case, it is also considered that the movable body is made to move backward in the movable body feeding apparatus mentioned above, and a user-friendly structure is required in the movable body feeding apparatus in which the movable body moves backward as mentioned above.

The present invention is made for achieving the problem mentioned above, and an object of the present invention is to provide an extruding container of an applying filler having a user-friendly structure.

Means for Solving the Problem

In accordance with the present invention, there is provided an applying filler extruding container capable of extruding an applying filler filled in a filling region within a container to a leading end side on the basis of a forward movement of a movable body arranged within the container, wherein the container comprises:

an operating tube structured in a closed-end tube and constituting a rear portion of the container; and a main body tube structured such as to be relatively rotatable in a leading end side of the operating tube, wherein a tubular body arranged so as to be non-rotatable and immovable in an axial direction and having a female thread in an inner circumference is provided in a middle portion of the inner circumference of the main body tube, wherein a male thread engaging with the female thread is provided in an outer circumference of the movable body, wherein a protruding portion is provided in a bottom portion of the operating tube so as to extend in an axial direction, wherein an engagement portion provided in the movable body is engaged with an engagement portion provided in the protruding portion of the operating tube so as to be non-rotatable and movable in the axial direction, and a rotation preventing portion of the movable body is structured by the engagement portions, wherein a click spring member structured in a tubular shape and having a click tooth and a compression spring portion is arranged in such a manner that the movable body passes through an inner side thereof, and a click mechanism is structured by being pinched between the tubular body and an inner portion of the operating tube, and wherein when the operating tube and the main body tube are relatively rotated in one direction or the other direction corresponding to an opposite direction to the one direction, the movable body moves forward or backward by the engagement portion constituted by the female thread and the male thread and the rotation preventing portion, and a click feeling is given by the click mechanism at this time.

In accordance with the applying filler extruding container having the structure mentioned above, when the operating tube and the main body tube are relatively rotated in one direction, the movable body moves forward by the engagement portion constituted by the female thread and the male thread and the rotation preventing portion constituted by the engagement portion of the movable body and the engagement portion of the protruding portion of the operating tube, so that the applying filler filled in the filling region is extruded forward to be ready to apply it, and at the time of forward movement, a click feeling is given by the click mechanism constituted by the click spring member which is structured in a tubular shape, provided with the click tooth and the compression spring portion, arranged in such a manner that the movable body passes through an inner side thereof and pinched between the tubular body and an inner portion of the operating tube. On the other hand, when the operating tube and the main body tube are relatively rotated in the other direction corresponding to an opposite direction to the one direction, the movable body moves backward by the engagement portion and the rotation preventing portion, and a click feeling is given by the click mechanism at the time of backward movement. Accordingly, a user can perceive forward movement and returning of the movable body and such is user-friendly.

In this case, as the click tooth, there can be specifically mentioned a chevron structure having an upward incline and a downward incline along a circumferential direction.

Further, as the click mechanism, there can be specifically mentioned a structure in which the click spring member is arranged in such a manner that the click tooth is directed toward the bottom portion side of the operating tube, and a predetermined engagement portion click engaging with the click tooth is provided in an inner portion of the operating tube.

Further, as the applying filler, there can be specifically mentioned a liquid filler.

EFFECT OF THE INVENTION

As mentioned above, in accordance with the applying filler extruding container of the present invention, since the forward moving degree and the returning degree of the movable body are detected by the user, it is possible to provide a user-friendly applying filler extruding container.

BEST MODE FOR CARRYING OUT THE INVENTION

Figure 1:
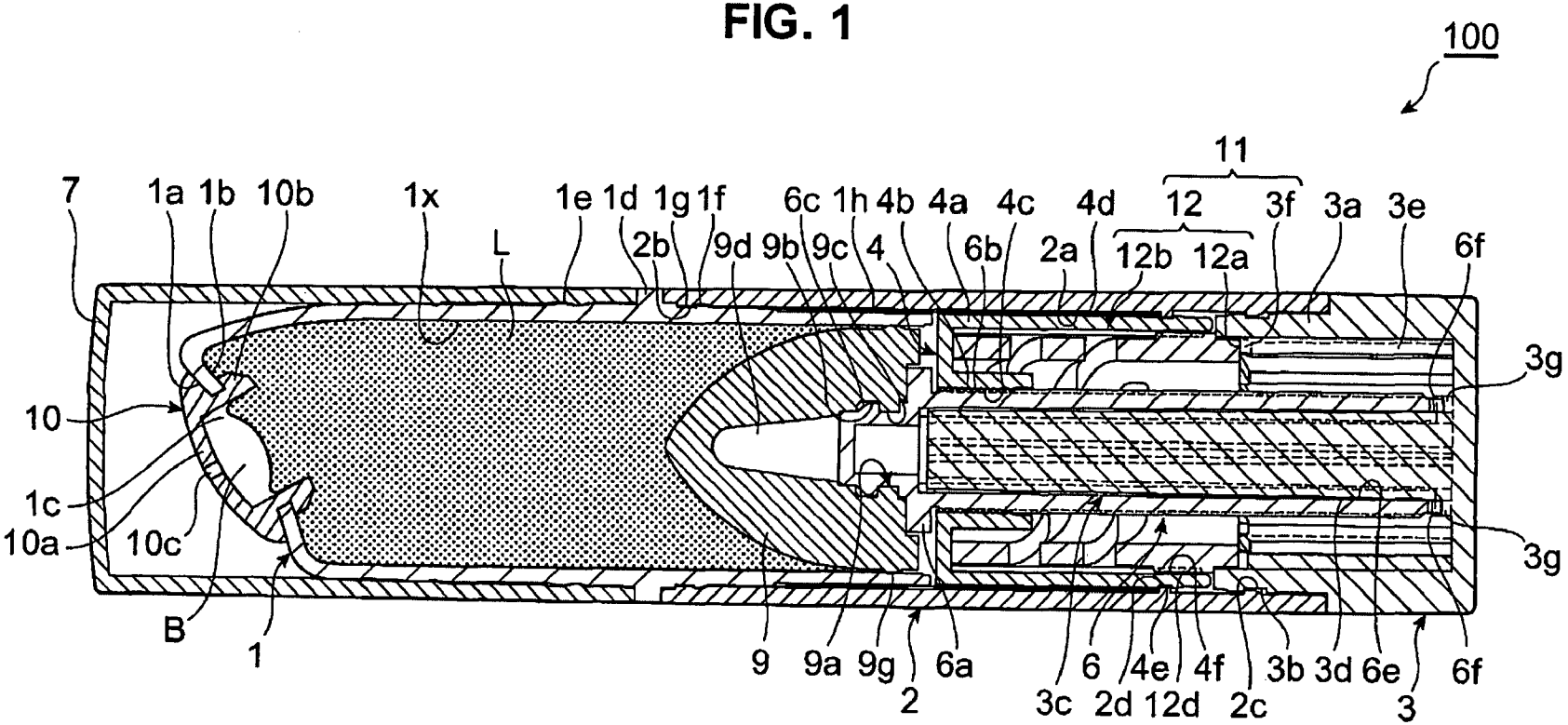
FIG. 1 is a longitudinal sectional view showing an applying filler extruding container in accordance with an embodiment of the present invention.

A description will be given of a preferable embodiment of an applying filler extruding container in accordance with the present invention with reference to FIGS. 1 to 26. In this case, each of the drawings, the same reference numerals are attached to the same elements and an overlapping description will be omitted.

The applying filler extruding container in accordance with the present embodiment can appropriately receive and extrude the applying filler on the basis of an operation of a user.

In this case, a lip gloss is employed as a particularly preferable example of the applying filler, however, the applying filler is not limited to this, but can be a liquid, a kneaded semisolid including a jelly and a paste, and a solid and the like, such as a lip color, an eye color, an eye liner, an essence, a cleaning solvent, a nail enamel, a nail care liquid solution, a nail enamel remover, a mascara, an anti-aging, a hair color, a hair cosmetic, an oral care, a massage oil, a keratotic plugging reducer, a foundation, a concealer, a skin cream, an ink for a writing instrument including a marking pen, a liquid medicine, a slurry and the like. It is particularly preferable for achieving the present invention to employ the applying filler having a high viscosity.

Figure 2:
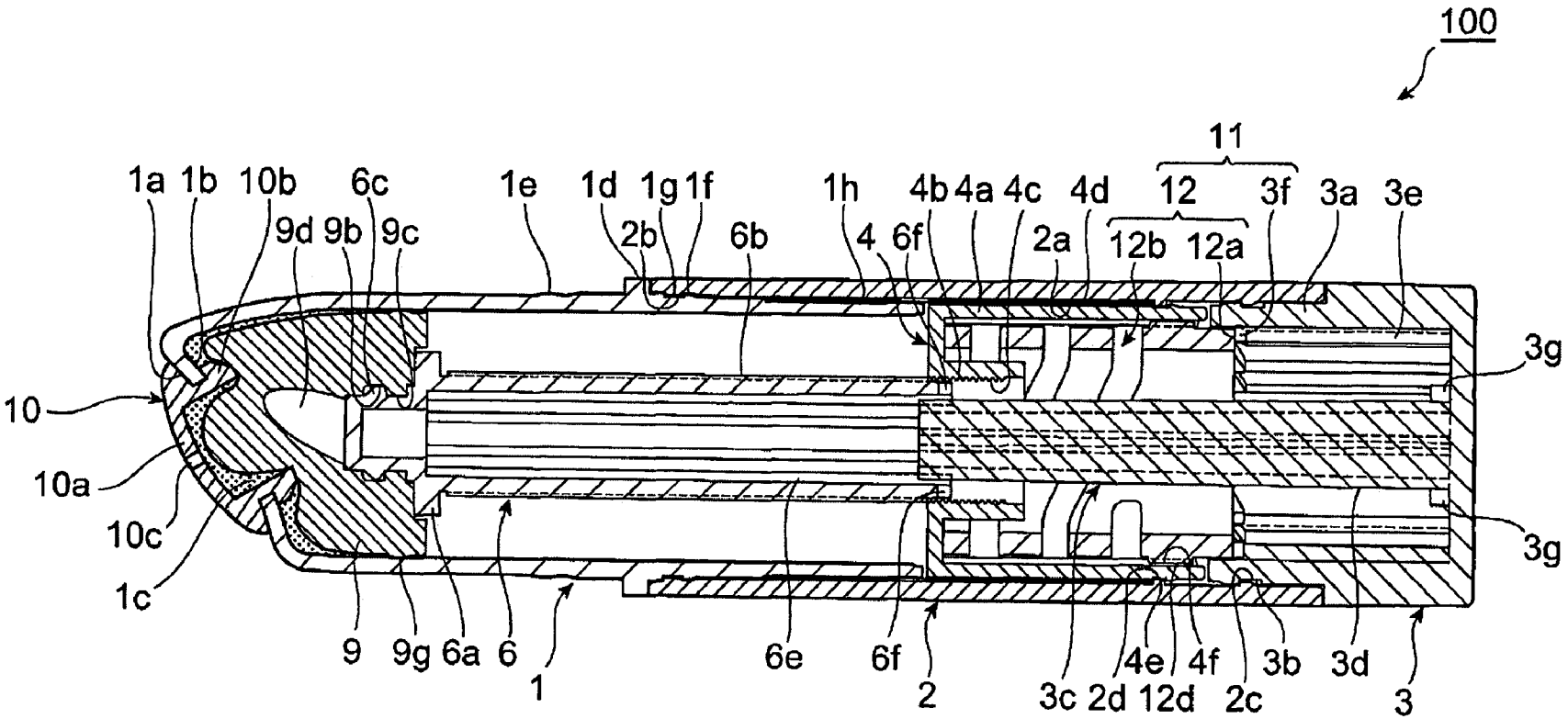
FIG. 2 is a longitudinal sectional view showing a state that a cap of the applying filler extruding container in accordance with the embodiment of the present invention is taken off, and that a movable body is at a maximum forward moving time.

As shown in FIGS. 1 and 2, an applying filler extruding container 100 is provided with a filling member 1 corresponding to a leading tube having in an inner portion a filling region 1*x* in which an applying filler L is filled, a main body tube 2 coupling the filling member 1 so as to be non-rotatable and immobile in an axial direction in a state in which a rear half portion of the filling member 1 is inserted into a front half portion thereof, an operating tube (a rear portion of the container) 3 coupled to a rear end portion of the main body tube 2 so as to be relatively rotatable and immobile in the axial direction, and an applying body 10 constituting a leading end portion of the filling member 1 and provided for applying the applying filler L, as an outer structure. Further, an inner side of the container is generally provided with a movable body 6 having an elastic body 9 in a leading end portion and moving forward and backward in the axial direction by relatively rotating the main body tube 2 or the filling member 1 and the operating tube 3, a thread tube (a tubular body) 4 serving as an engagement mechanism which can move the movable body 6 on the basis of the relative rotation, and a click mechanism 11 giving a click feeling in synchronous with the relative rotation in forward and reverse directions.

Figure 3:
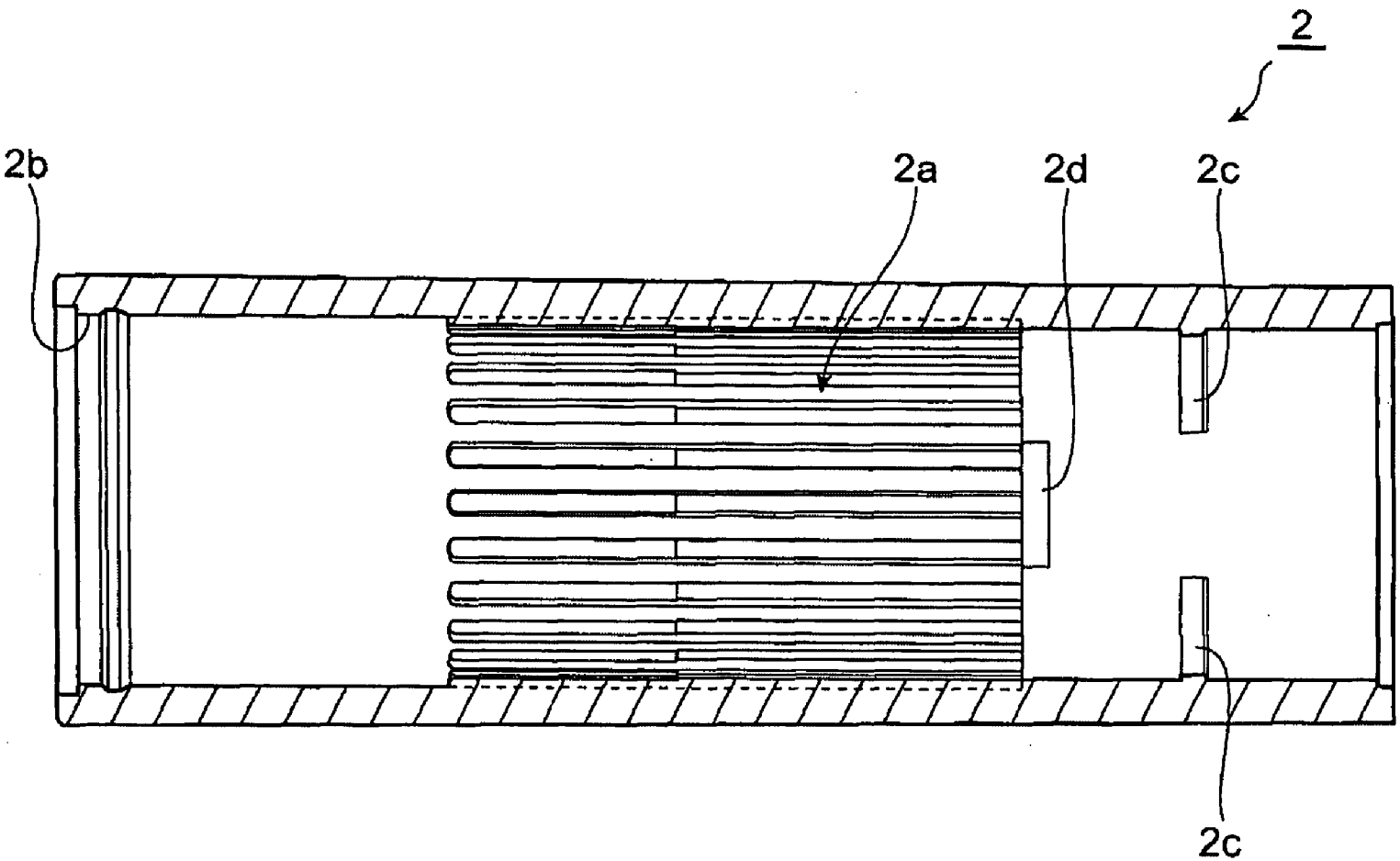
FIG. 3 is a longitudinal sectional view showing a main body tube in FIGS. 1 and 2.
Figure 4:
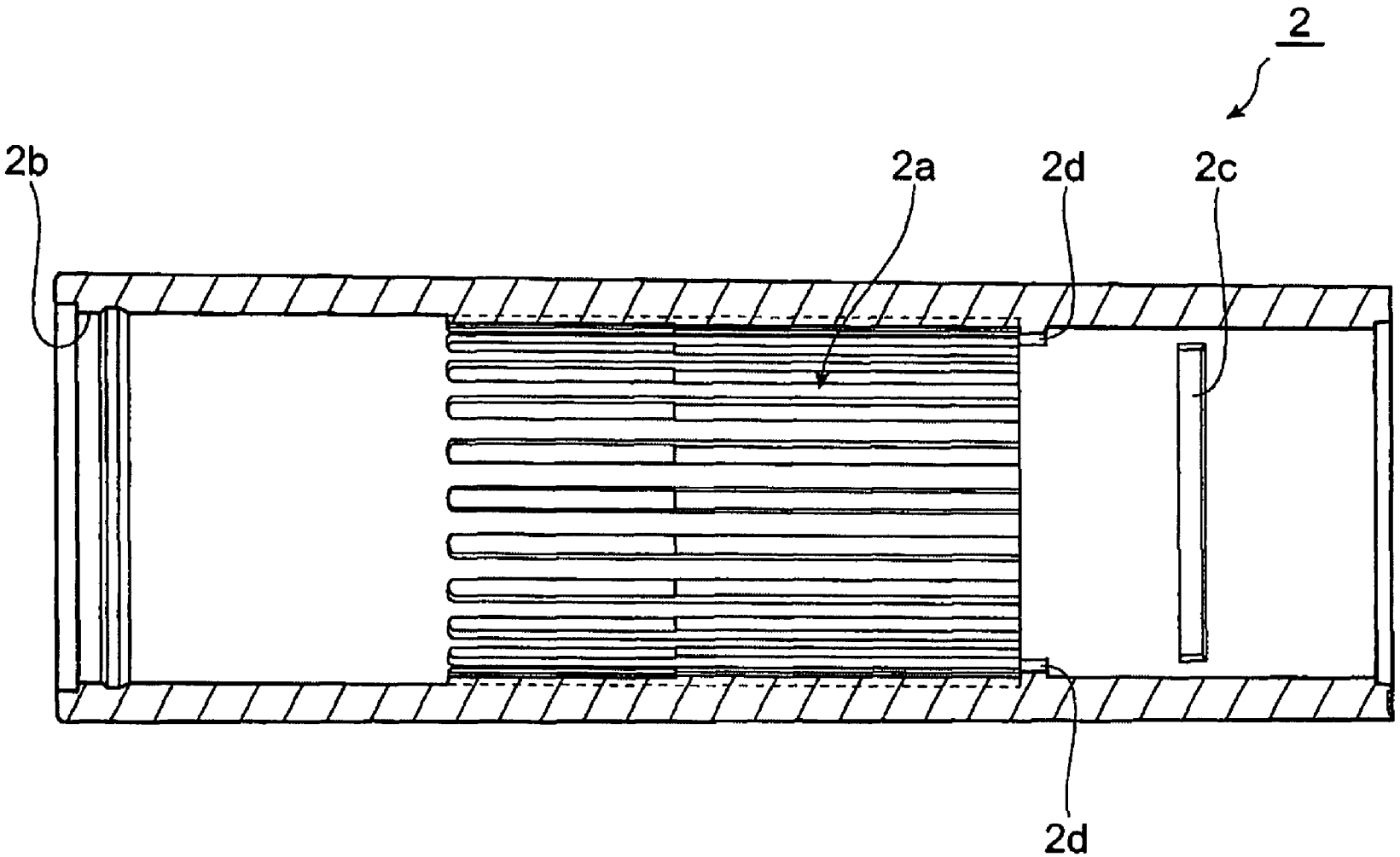
FIG. 4 is an orthogonal longitudinal sectional view of the main body tube shown in FIG. 3.

As shown in FIGS. 3 and 4, the main body tube 2 is structured in a cylindrical shape, and has a knurling 2*a*, which is provided with a lot of concavities and convexities in parallel in a peripheral direction and in which the concavities and convexities extend at a predetermined length in an axial direction, in an inner peripheral surface of a center portion in an axial direction thereof. The knurling 2*a* is provided such that a front half portion thereof engages the filling member 1 in a rotating direction, and a rear half portion engages the thread tube 4 in the rotating direction. Further, an annular protruding portion 2*b* for engaging the filling member 1 in an axial direction is provided in an inner peripheral surface of a leading end portion of the main body tube 2. Further, two protruding portions 2*c* extending in a circular arc shape along a peripheral direction are formed in an inner peripheral surface in a rear portion side of the main body tube 2, and two protruding portions 2*d* extending in a circular arc shape along a peripheral direction are formed at a front side position from the circular arc shaped protruding portion 2*c*. The circular arc shaped protruding portion 2*c* is provided for engaging the operating tube 3 in the axial direction, and the circular arc shaped protruding portion 2*d* is provided for engaging the thread tube 4 in the axial direction. The circular arc shaped protruding portion 2*c* and the circular arc shaped protruding portion 2*d* are provided at positions which do not overlap in the axial direction.

Figure 5:
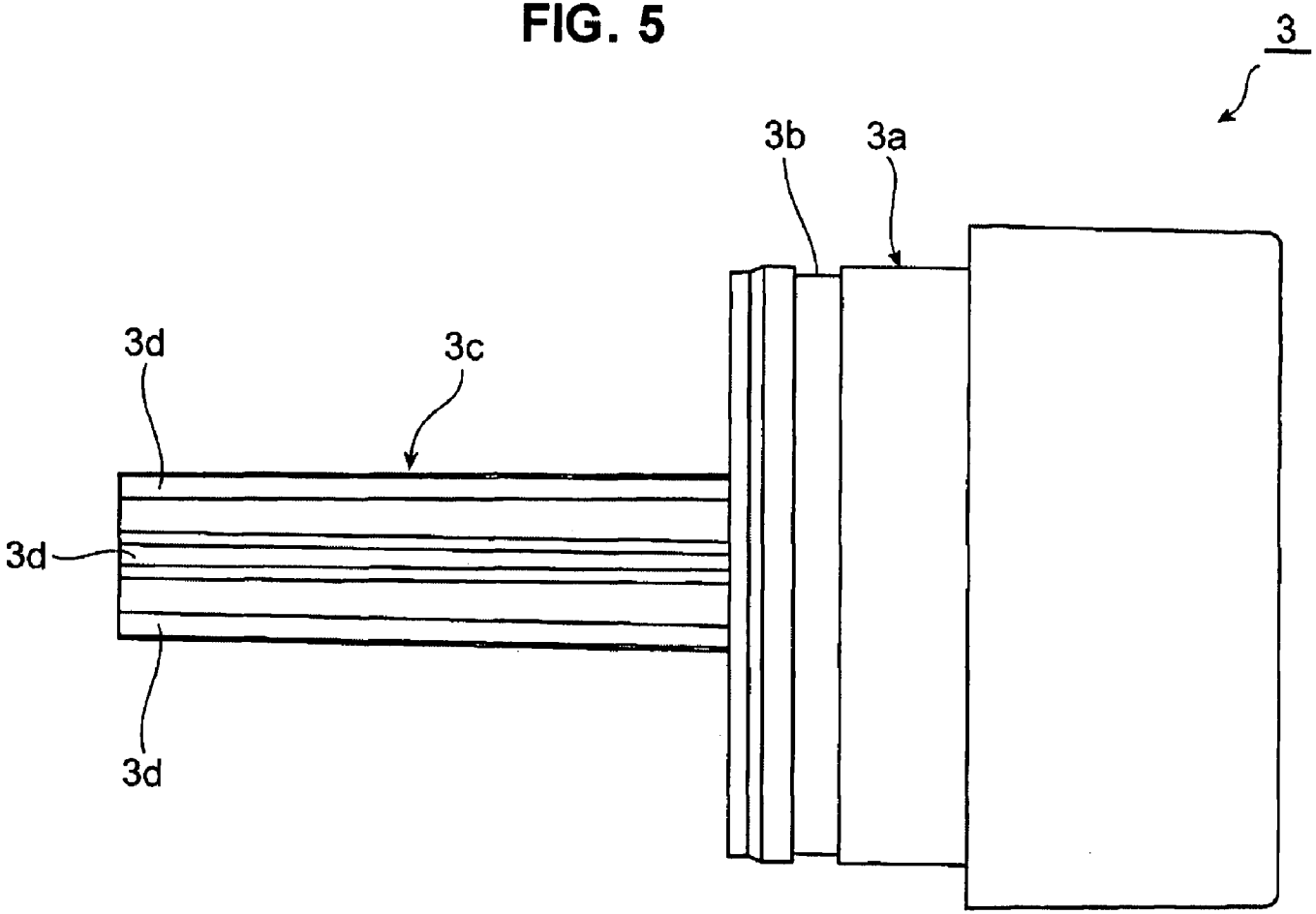
FIG. 5 is a side view showing an operating tube in FIGS. 1 and 2.
Figure 6:
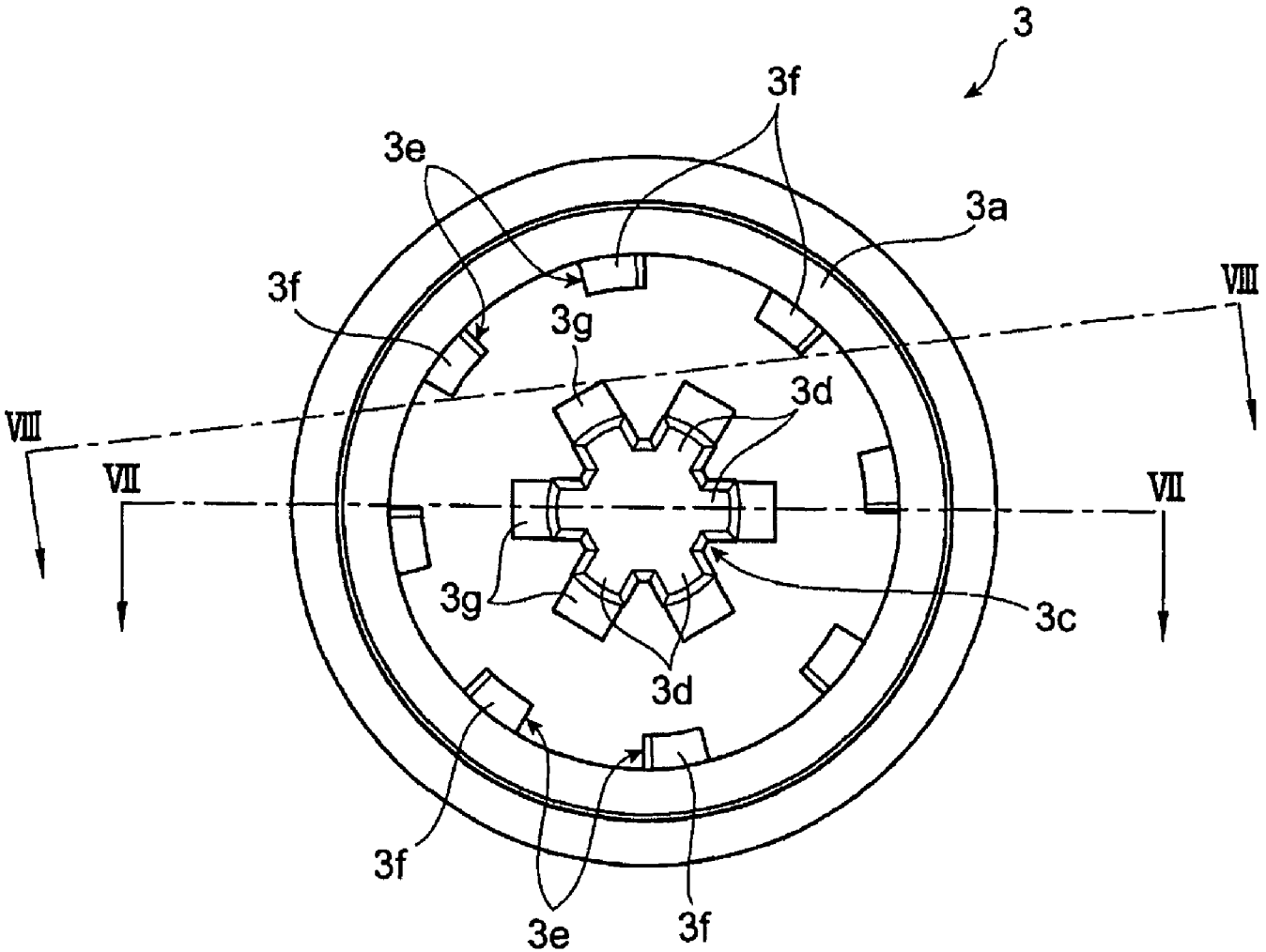
FIG. 6 is a left side view of the operating tube shown in FIG. 5.
Figure 7:
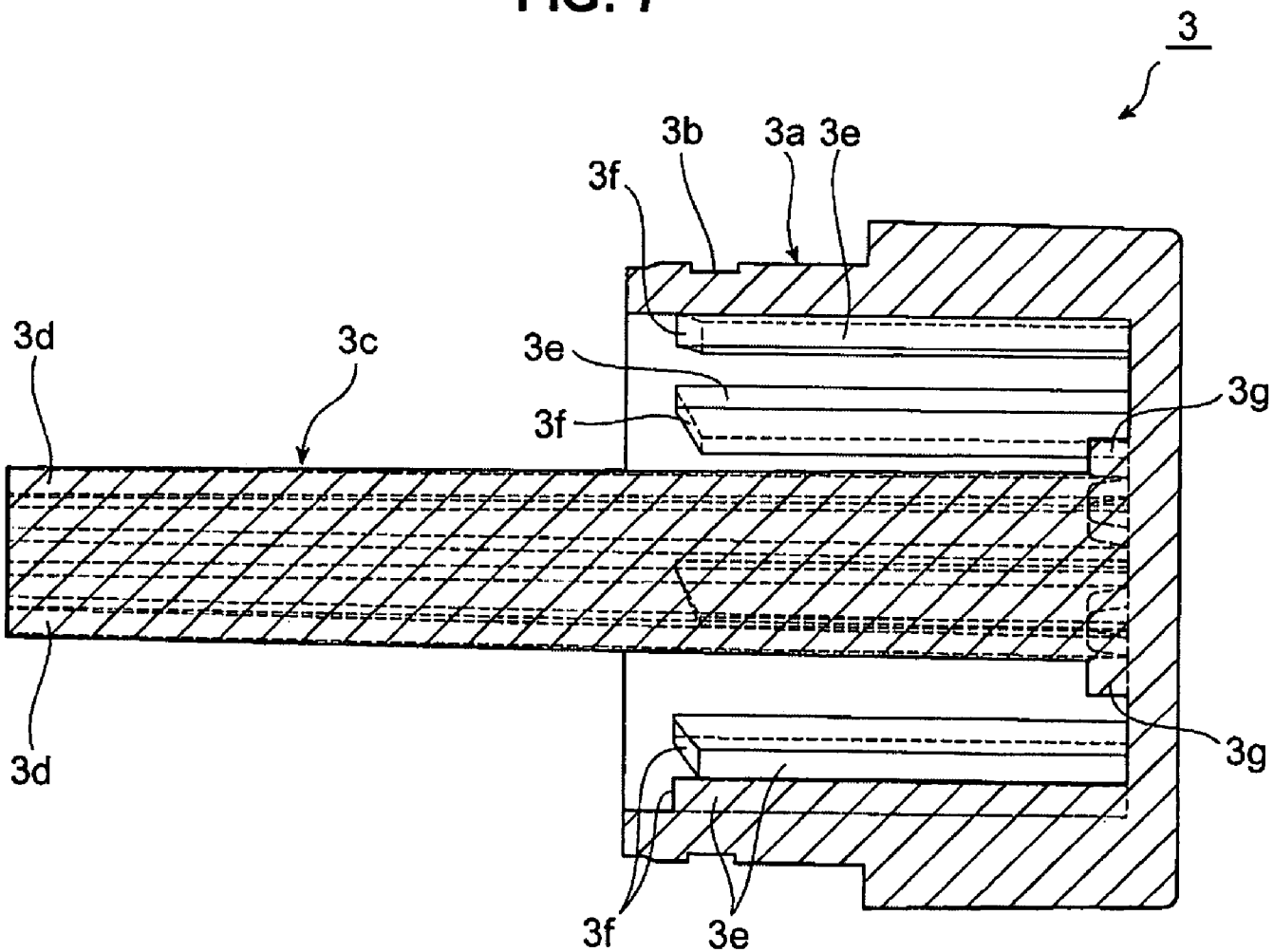
FIG. 7 is a view as seen in an arrow direction at a line VII—VII in FIG. 6.
Figure 8:
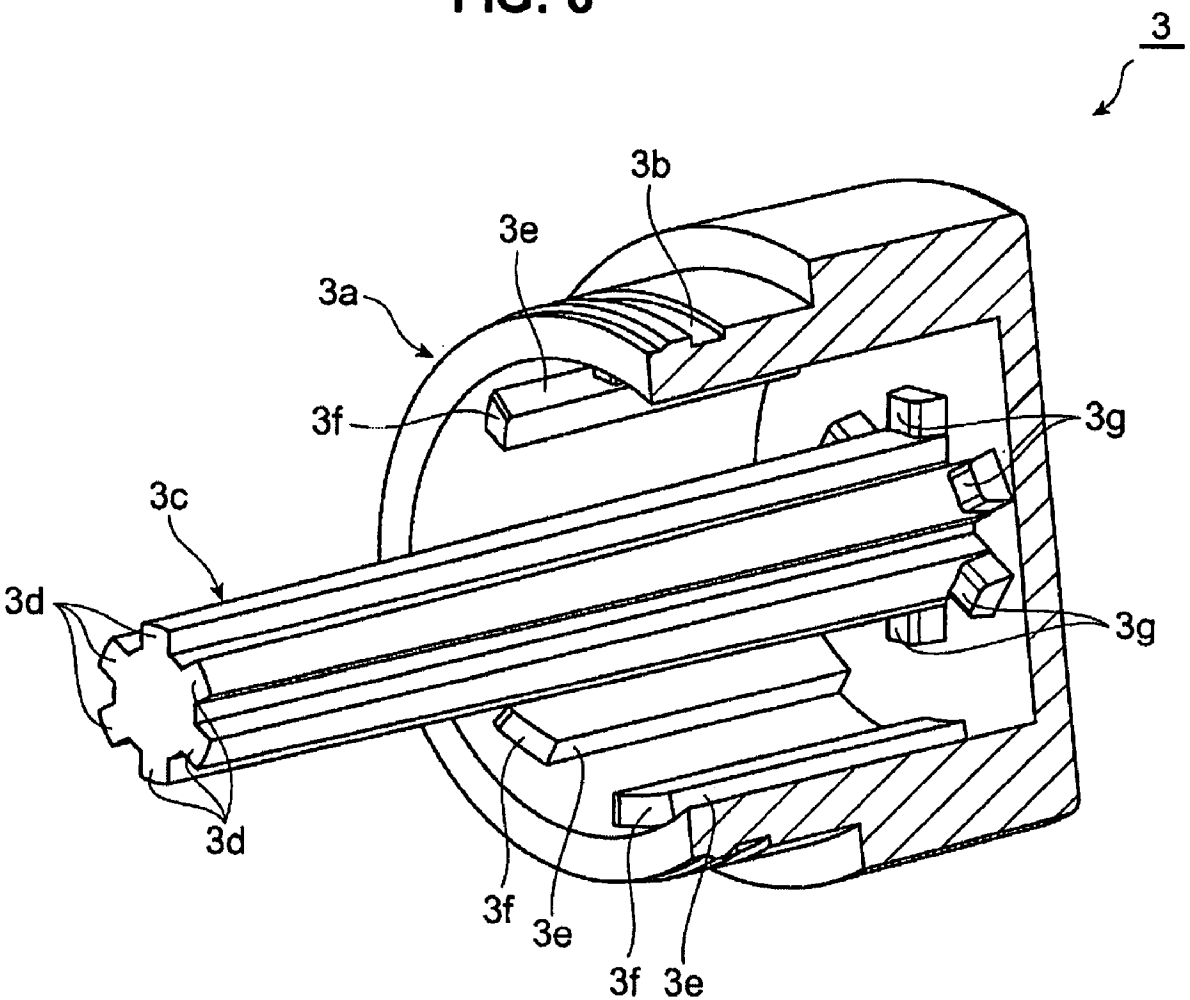
FIG. 8 is a perspective view along a line VIII—VIII in FIG. 6.

The operating tube 3 is structured in a closed-end cylindrical shape as shown in FIGS. 5 to 8, is provided with a leading end tube portion 3*a* having a small outer diameter in a leading end side, and is provided with an annular groove portion 3*b* for engaging with the circular arc shaped protruding portion 2*c* of the main body tube 2 in the axial direction, as shown in FIGS. 5, 7 and 8, in an outer peripheral surface of the leading end tube portion 3*a*.

A shaft body (a protruding portion) 3*c* is provided in a rising manner in a center of a bottom portion in the operating tube 3 so as to extend toward a leading end side, as shown in FIGS. 5 to 8. The shaft body 3*c* is formed in a non-circular shape in cross section provided with protrusions (an engagement portion) 3*d* arranged so as to protrude in a radial direction at six equal positions along a peripheral direction on an outer peripheral surface of a columnar body and extending in an axial direction, and the protrusions 3*d* are formed as a rotation prevention constituting one side of rotation preventing mechanisms (rotation preventing portions) of the movable body 6.

Further, as shown in FIGS. 6 to 8, the operating tube 3 is provided with protrusions 3*e* extending toward a leading end side from a bottom portion at eight equal positions along the peripheral direction, in an inner peripheral surface thereof. In the protrusion 3*e*, a leading end portion 3*f* is formed as a predetermined engagement portion constituting a click mechanism 11. Further, in the present embodiment, a leading end surface of the leading end portion 3*f* of the protrusion 3*e* is formed as an inclined surface inclined in one direction.

Further, a peripheral edge of the shaft body 3*c* in a bottom surface of the operating tube 3 is provided with a protruding portion 3*g* protruding short to the leading end side and formed as a protrusion for engaging with the movable body 6 in a rotating direction at the maximum retreated time of the movable body 6. The protruding portion 3*g* structures one side of shaft body wrench-off preventing mechanisms for preventing the shaft body 3*c* from being wrenched off at a time when an excessive rotating force is applied to the shaft body 3*c*, and is provided so as to be connected to a rear end portion of each of the protrusions 3*d* of the shaft body 3*c*.

The operating tube 3 is inside inserted to the main body tube 2 from the leading end tube portion 3*a* as shown in FIGS. 1 and 2, a step surface between the leading end tube portion 3*a* and a closed-end portion in a rear side thereof is brought into contact with a rear end surface of the main body tube 2, and the annular groove portion 3*b* engages with the circular arc shaped protruding portion 2*c* of the main body tube 2, thereby the operating tube 3 being attached to the main body 2 so as to be rotatable and immobile in the axial direction.

Figure 13:
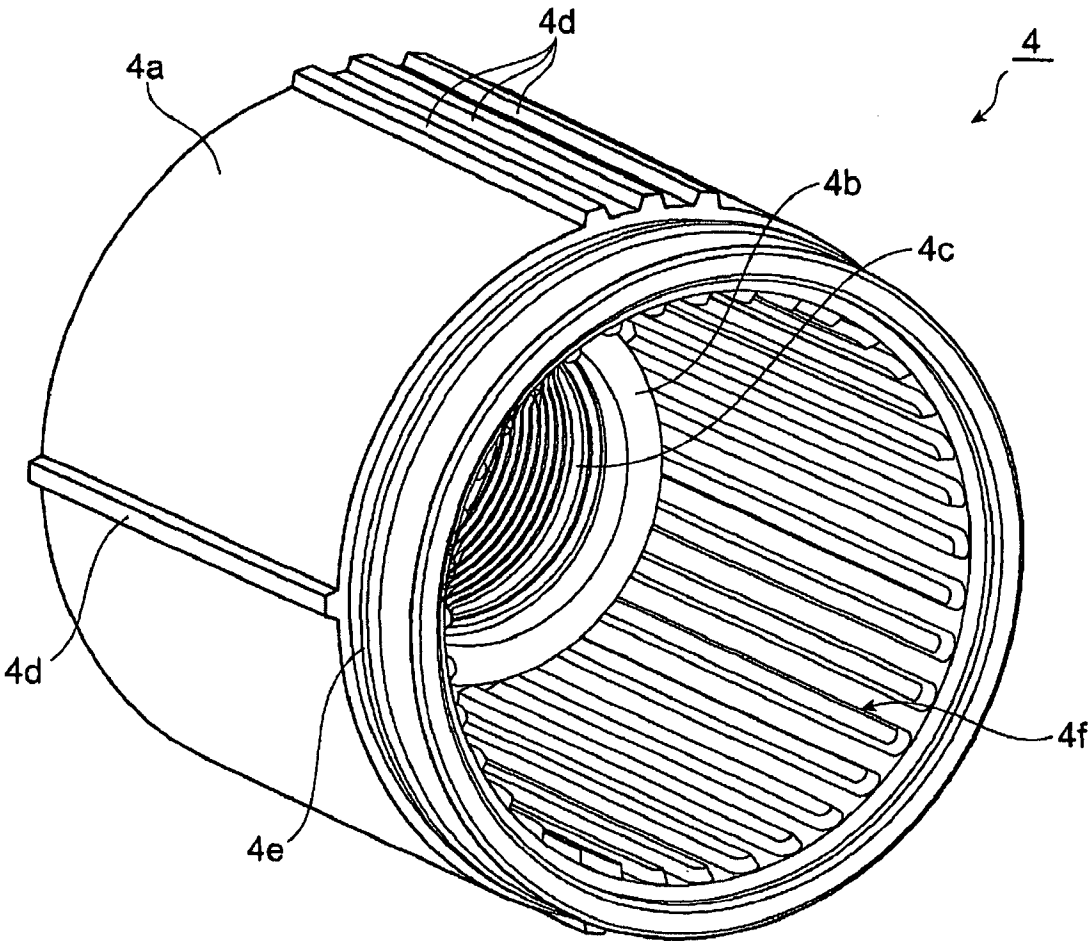
FIG. 13 is a perspective view showing a thread tube in FIGS. 1 and 2.
Figure 14:
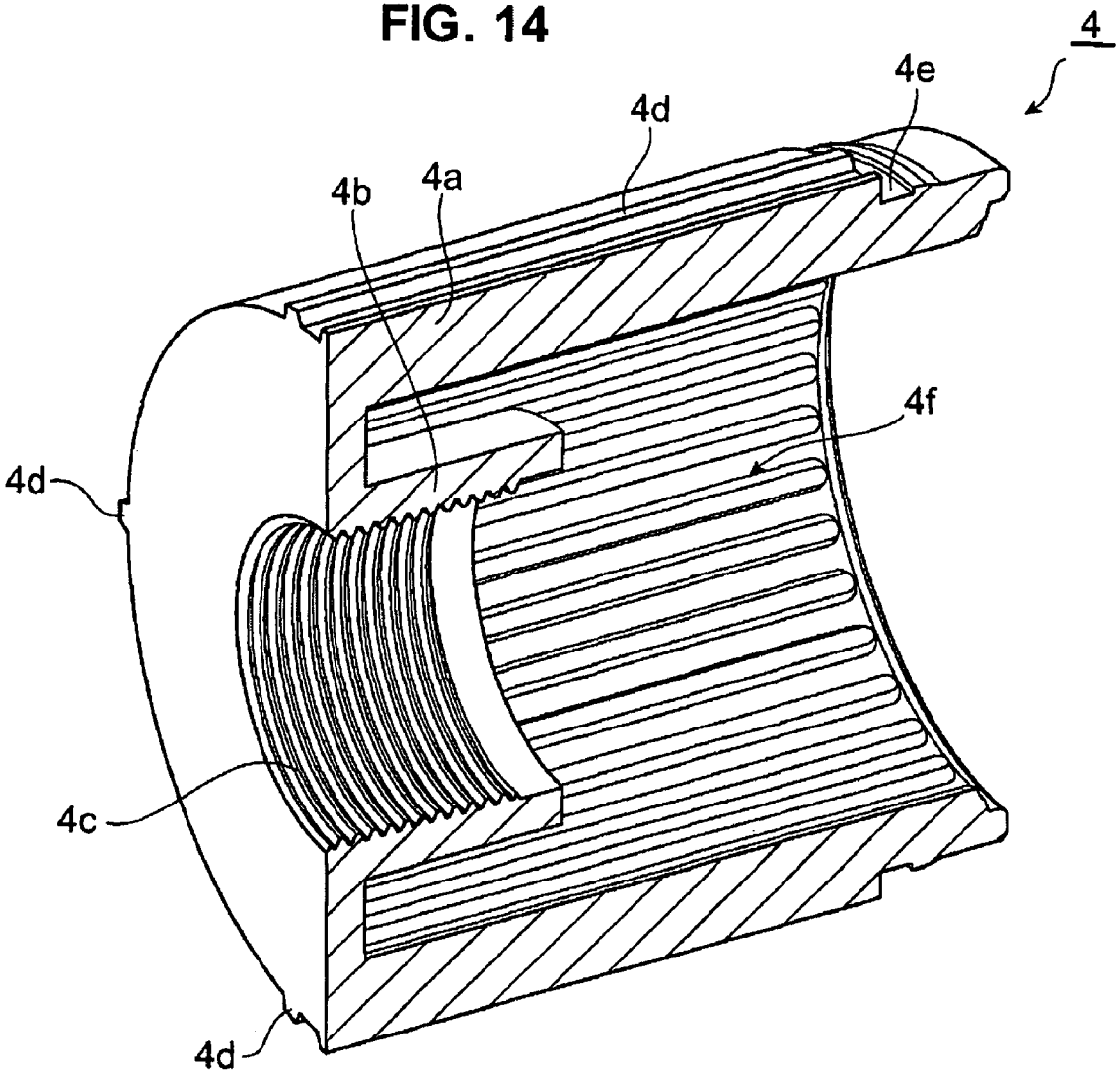
FIG. 14 is a longitudinal sectional perspective view of the thread tube shown in FIG. 13.

The thread tube 4 is formed in such a shape that an inside cylindrical tubular body 4*b* is connected to a leading end side of an outer cylindrical tubular body 4*a*, as shown in FIGS. 13 and 14, and is provided with a female thread 4*c* structuring one side of engagement mechanisms (engagement portions) in an inner peripheral surface of the inside tubular body 4*b*. A protrusion 4*d* for engaging with the knurling 2*a* of the main body tube 2 in the rotating direction is formed from a leading end to a rear end portion at a plurality of positions in the peripheral direction, on an outer peripheral surface of the outer tubular body 4*a* structuring the thread tube 4, and an annular groove portion 4*e* for engaging with the circular arc shaped protruding portion 2*d* of the main body tube 2 in the axial direction is formed at a position close to the rear end surface. Further, an inner peripheral surface of the outer tubular body 4*a* is provided with a knurling 4*f* in which a lot of concavities and convexities are provided in parallel and the concavities and convexities extend in an axial direction. The knurling 4*f* is provided for engaging a click spring member 12 constituting the click mechanism 11 in a rotating direction.

The thread tube 4 is inside inserted to the main body tube 2 from a rear end portion thereof as shown in FIGS. 1 and 2, the annular groove portion 4*e* is engaged with the circular arc shaped protruding portion 2*d* of the main body tube 2, and the protrusion 4*d* is engaged with the knurling 2*a* of the main body tub 2, thereby the thread tube 4 being attached to the main body tube 2 so as to be no-rotatable and immobile in the axial direction.

Figure 15:
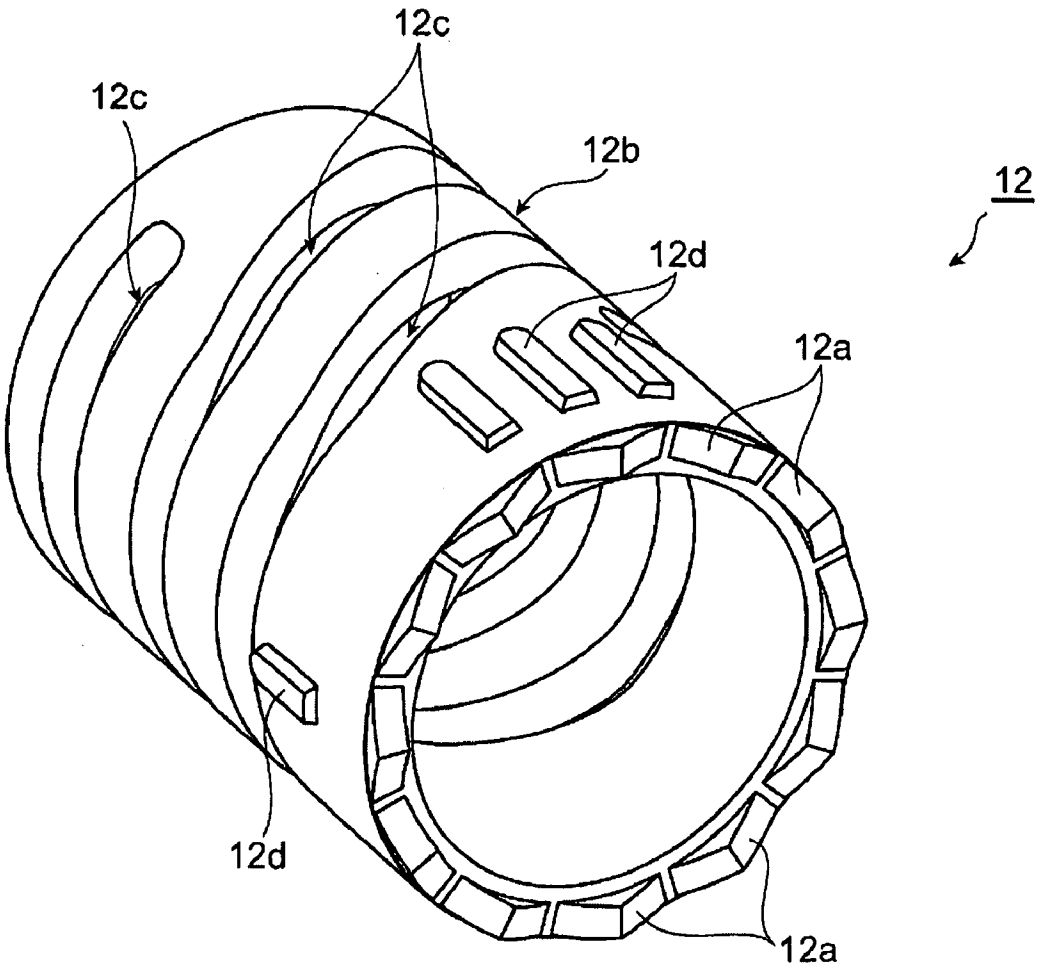
FIG. 15 is a perspective view of a click spring member in FIGS. 1 and 2 as seen from the rear.
Figure 16:
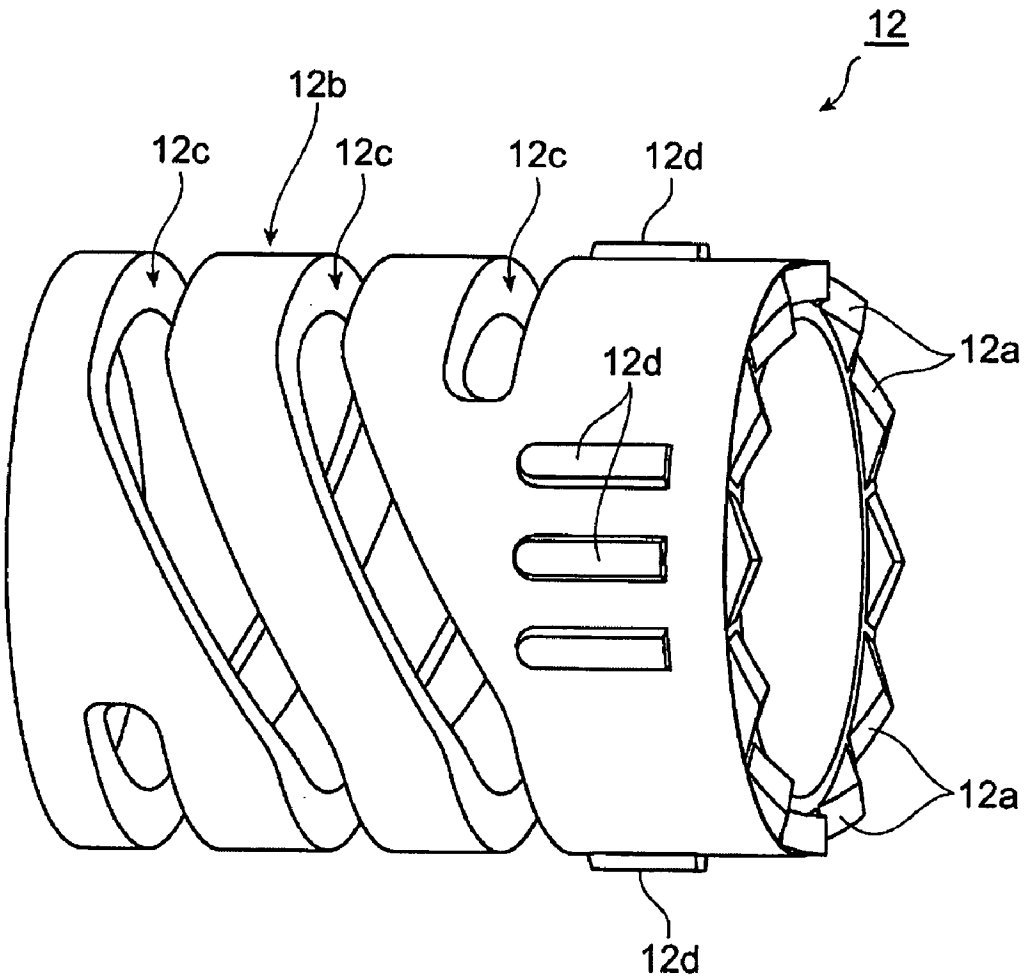
FIG. 16 is a perspective view of the click spring member shown in FIG. 15 as seen from the side.

The click spring member 12 constitutes a rotating amount regulating member, and is formed as an injection molded product by a resin. The click spring member 12 is structured approximately in a cylindrical shape as shown in FIGS. 15 and 16, and is integrally formed in a rear end surface thereof so as to have click teeth 12*a* in which concavo-convex portions engaging with the leading end portions 3*f* of the protrusions 3*e* of the operating tube 3 are provided along a peripheral direction, and have a compression spring portion 12*b* serving as an elastic portion connecting to a rear end portion having the click teeth 12*a*. The click tooth 12*a* is structured in a chevron shape having an ascending incline and a descending incline along the peripheral direction. Further, the compression spring portion 12*b* is provided with an approximately spiral slit 12*c* in a peripheral wall thereof, and energizes the pressed click teeth 12*a* against the pressing force by the slit 12*c*. Further, a plurality of protrusions 12*d* for engaging with the knurling 4*f* of the thread tube 4 in the rotating direction are provided in an outer peripheral surface of a rear end portion of the click spring member 12 along the peripheral direction.

In the click spring member 12, as shown in FIGS. 1 and 2, the leading end portion is received in the thread tube 4 so as to be positioned between the outer tubular body 4*a* and the inner tubular body 4*b* of the thread tube 4, and the protrusions 12*d* are engaged with the knurlings 4*f* of the thread tube 4, whereby the click spring member 12 is set non-rotatable with respect to the thread tube 4. In this state, the click spring member 12 is arranged so as to be pinched between a back face of the leading end portion connecting the outer and inner tubular bodies 4*a* and 4*b* of the thread tube 4 and the leading end portions 3*f* of the protrusions 3*e* of the operating tube 3. Further, the click teeth 12*a* of the click spring member 12 are energized to a rear side by the compression spring portion 12*b*, and is set in a click engagement state with respect to the leading end portions 3*f* of the protrusions 3*e* of the operating tube 3.

In this case, the shapes of the click tooth 12*a* of the click spring member 12 and the leading end portion 3*f* of the protrusion 3*e* of the operating tube 3 engaged by click therewith are not limited to those mentioned above, but may employ other shapes as far as the click engagement is achieved by the relative rotation in the forward and reverse directions.

Figure 9:
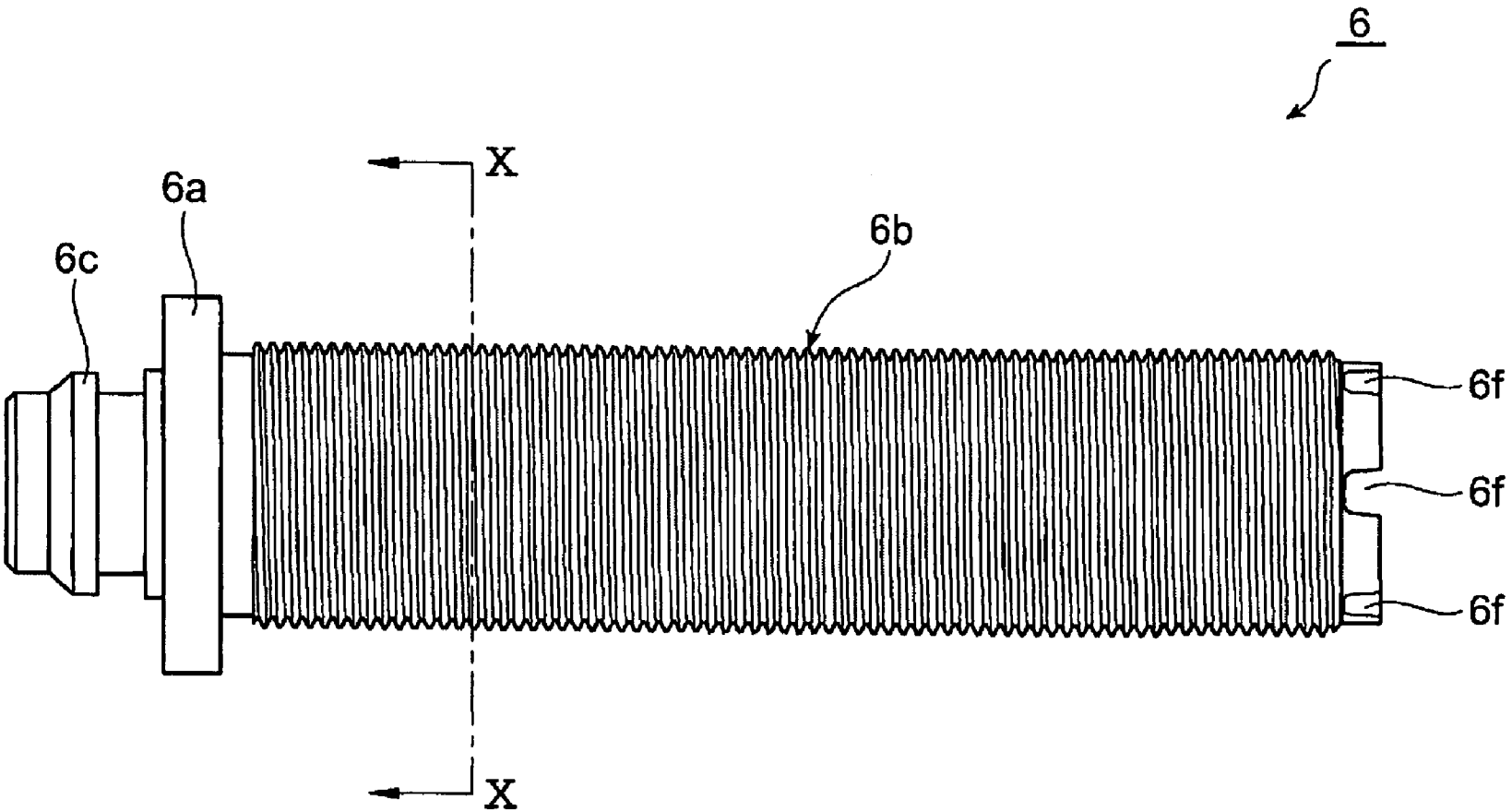
FIG. 9 is a side view showing the movable body in FIGS. 1 and 2.
Figure 10:
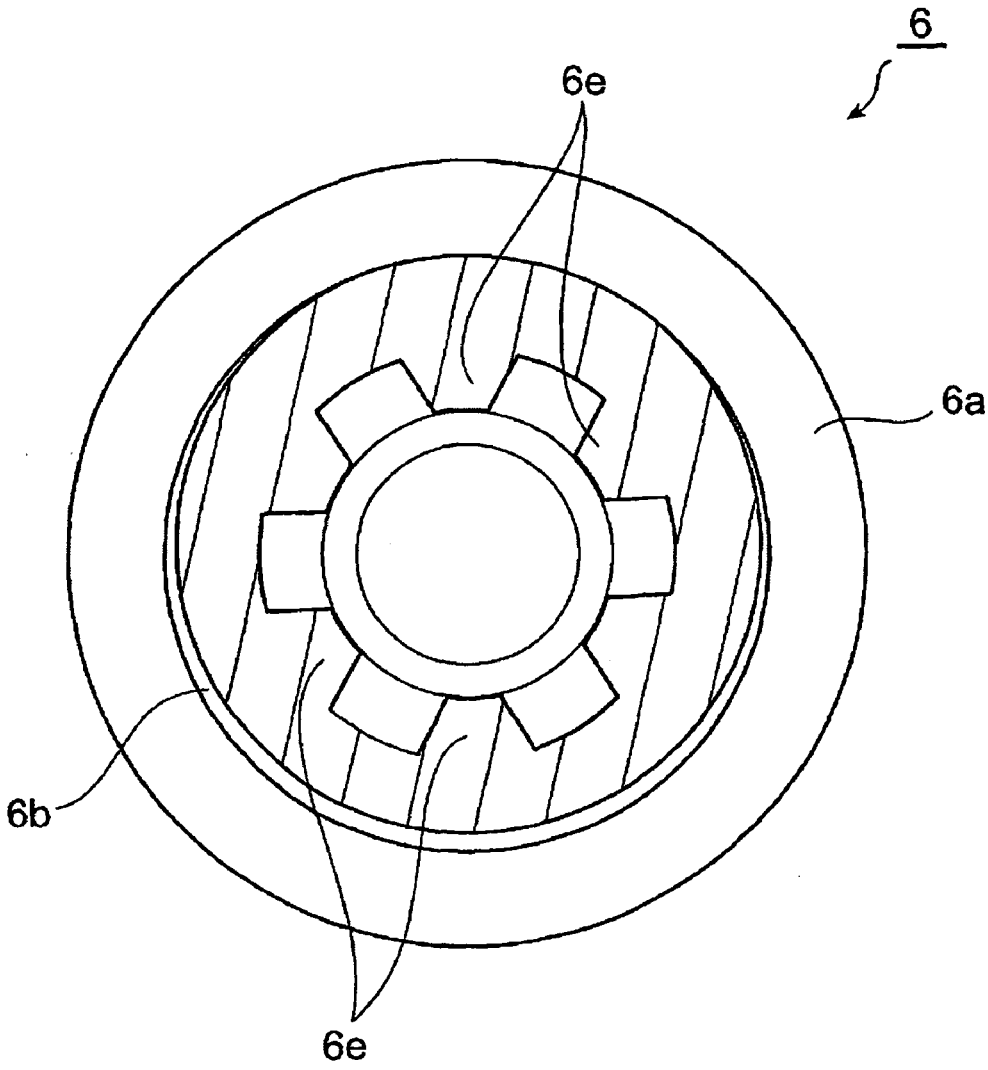
FIG. 10 is a view as seen in an arrow direction at a line X—X in FIG. 9.
Figure 11:
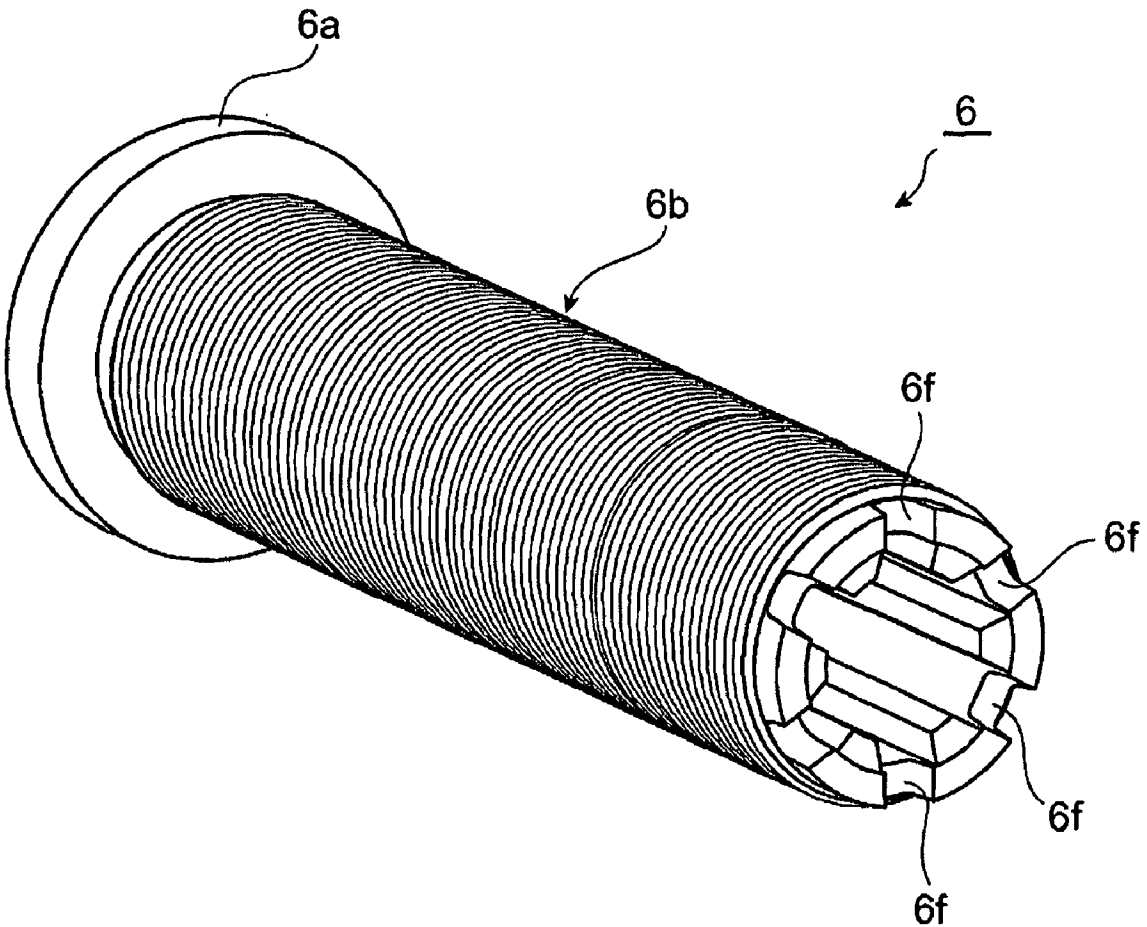
FIG. 11 is a perspective view of the movable body shown in FIG. 9
Figure 12:
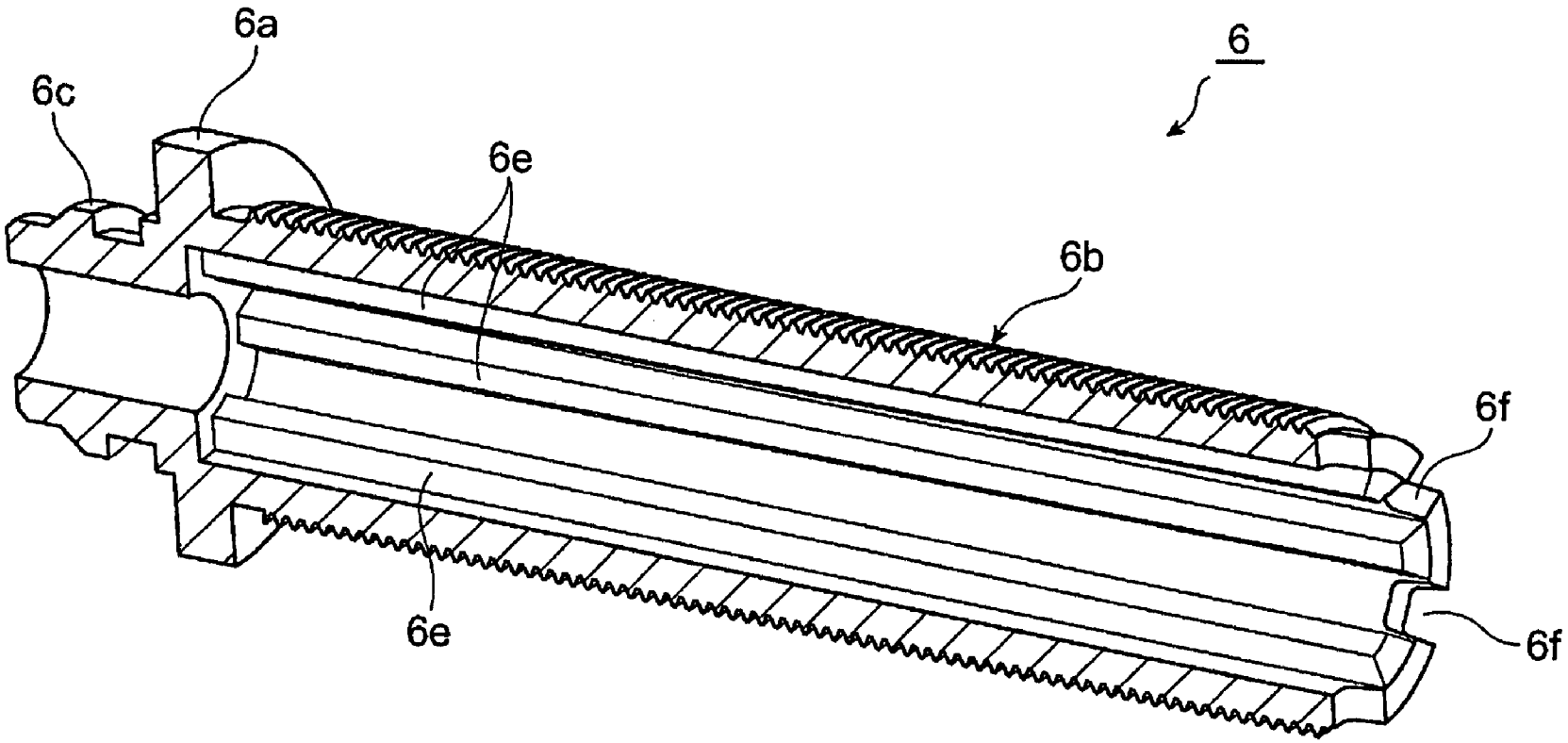
FIG. 12 is a longitudinal sectional perspective view of the movable body shown in FIG. 11.

The movable body 6 is structured in the cylindrical shape having a collar portion 6*a* in a leading end side, as shown in FIGS. 9 to 12, and is provided with a male thread 6*b* constituting the other side of the engagement mechanisms (the engagement portions) in an outer peripheral surface extending to a rear end portion from a rear side of the collar portion 6*a*. Further, an annular protruding portion 6*c* for engaging the elastic body 9 in an axial direction is formed in an outer peripheral surface of a front side of the collar portion 6*a* of the movable body 6, as shown in FIGS. 9 and 12. Further, as shown in FIG. 12, an inner peripheral surface reaching a rear end from the periphery of the collar portion 6*a* of the movable body 6 is provided with protrusions 6*e* arranged so as to protrude to an inner side in a radial direction and extending in the axial direction, at six equal positions along the peripheral direction, as shown in FIGS. 10 and 12, and the protrusions 6*e* are formed as the rotation prevention constituting the other side of the rotation preventing mechanism (the rotation preventing portion) of the movable body 6. Further, a rear end surface of the movable body 6 is provided with grooves 6*f* serving as a concave portion concaved short to the leading end side and communicating the inner and outer sides of the movable body 6, at six equal positions along the peripheral direction, as shown in FIGS. 11 and 12. The grooves 6*f* constitute the other side of the shaft body wrench-off preventing mechanisms, and move forward to the protruding portion 3*g* of the operating tube 3 and engages in the rotating direction at the maximum retreated time of the movable body 6.

The movable body 6 is outside inserted to the shaft body 3*c* of the operating tube 3 from the rear end portion thereof and is inside inserted to the tubular body 4*b* in the inner side of the thread tube 4, as shown in FIGS. 1 and 2. In a state in which the male thread 6*b* is engaged with the female thread 4*c* of the thread tube 4, the protrusion 6*e* is engaged with a portion between the protrusions 3*d* and 3*d* of the shaft body 3*c* and is attached to the operating tube 3 so as to be non-rotatable and movable in the axial direction.

The elastic body 9 is formed by a soft elastic material which tends to be elastically deformed, for example, a silicone rubber or the like. In addition to the silicone rubber, it is possible to select a thermosetting raw material in accordance with compression molding such as a nitrile rubber (NBR), an ethylene propylene rubber (EPR), a butyl rubber (IIR) and the like, and a thermoplastic raw material in accordance with an injection molding such as a polyurethane-based elastomer (TPU), a polyolefin-based elastomer (TPO), a polyester-based elastomer (TPEE) and the like.

The elastic body 9 is formed in a bell shape tapered toward a leading end, as shown in FIG. 1, is provided with a stepped concave portion 9*a* extending at a predetermined length toward a leading end side from the rear end surface, and has an annular groove portion 9*b* and an annular protruding portion 9*c* for engaging with the annular protruding portion 6*c* of the movable body 6 in the axial direction, in a rear portion side of the concave portion 9*a*. Further, the elastic body 9 is provided in an outer peripheral surface of a rear end portion with an annular protruding portion 9*g* closely attached to the inner peripheral surface of the filling member 1 for securing water tightness.

The elastic body 9 is outside inserted to the movable body 6 from a rear portion side thereof, the rear end surface is brought into contact with the leading end surface of the collar portion 6*a* of the movable body 6, and the annular groove portion 9*b* and the annular protruding portion 9*c* are engaged with the annular protruding portion 6*c* of the movable body 6, whereby the elastic body 9 is attached to the movable body 6 so as to be rotatable and immobile in the axial direction. In this state, a space 9*d* for promoting elastic deformation of the elastic body 9 is defined in a front half side within the elastic body 9, by the leading end portion of the movable body 6 moving forward into the concave portion 9*a*. Dimensions, an arrangement and the like of the elastic body 9 are set such that the elastic body 9 reaches the rear end portion of the applying body 10 in the leading end of the filling member 1 in the case that the movable body 6 moves forward to the maximum.

Figure 18:
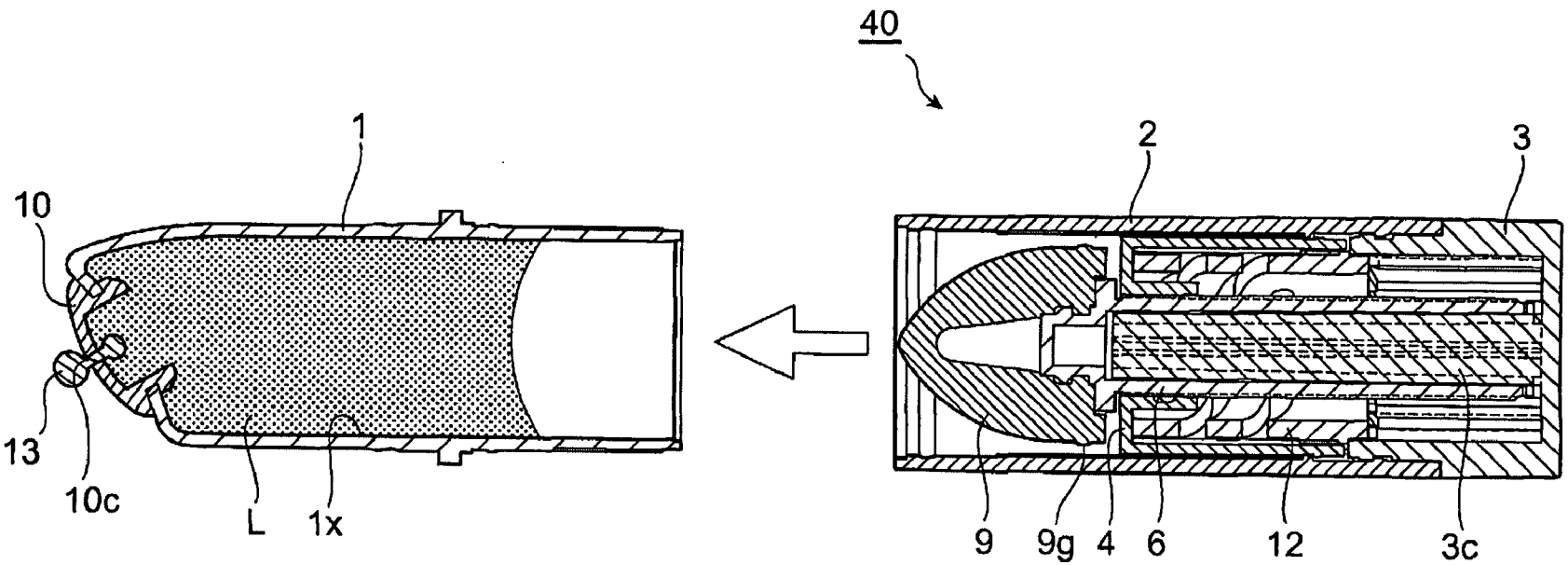
FIG. 18 is an exploded perspective view showing an assembling procedure of the applying filler extruding container shown in FIG. 1.

Further, the engagement mechanism is constituted by the male thread 6*b* of the movable body 6 and the female thread 4*c* of the thread tube 4, the rotation preventing mechanism is constituted by the protrusions 6*e* of the movable body 6 and the protrusions 3*d* of the shaft body 3*c*, the click mechanism 11 is constituted by the click teeth 12*a* and the compression spring portion 12*b* of the click spring member 12, and the leading end portions 3*f* of the protrusions 3*e* of the operating tube 3, and the extruding mechanism of the applying filler L constituted by them, the movable body 6 and the elastic body 9 are installed in the main body side tube body comprising the main body tube 2 and the operating tube 3, whereby the main body side assembly 40 is structured (refer to FIG. 18).

The filling member 1 is provided for filling the applying filler L in the inner filling region 1*x*, and is provided for discharging the applying filler L from the leading end portion in accordance with the operation by a user. It is preferable that the material of the filling member 1 is constituted by an injection molded plastic such as a polyethylene terephthalate (PET), a polypropylene (PP) or the like, and it is preferable that the material is constituted by a transparent material for checking out a color tone and a filling condition of the applying filler L.

Figure 17:
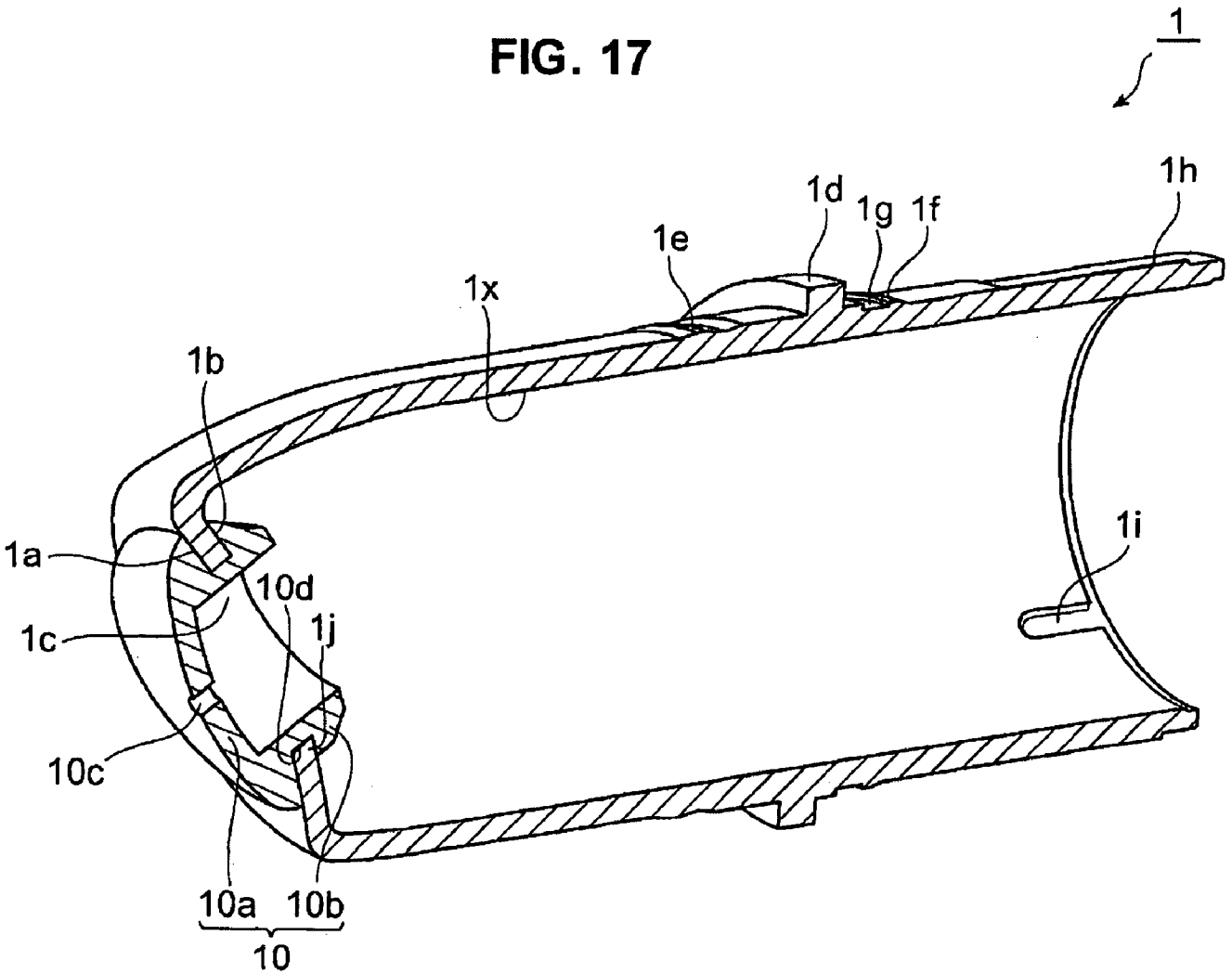
FIG. 17 is a longitudinal sectional perspective view showing a filling member in FIGS. 1 and 2.

The filling member 1 is formed in a cylindrical shape as shown in FIGS. 1, 2 and 17, and an outer surface 1*a* of the leading end portion is formed as an inclined surface inclined in a predetermined direction. Further, an inner surface 1*b* formed as an inclined surface is formed in the leading end portion of the filling member 1 at a distance of a fixed thickness with respect to the outer surface 1*a*, and an opening 1*c* communicating the inner surface 1*b* with the outer surface 1*a* is provided.

Further, an outer peripheral surface of the filling member 1 is provided with a collar portion 1*d* in which an outer diameter is made large so as to be brought into contact with an open end in a leading end side of the main body tube 2, approximately in a center portion in the axial direction, and an annular protruding portion 1*e* for detachably locking a cap 7 (refer to FIG. 1) covering a front side of the collar portion 1*d* of the filling member 1 in the axial direction is provided at a front position close to the collar portion 1*d*. Further, the annular groove portion 1*g* and the annular protruding portion 1*f* for being engaged with the annular protruding portion 2*b* of the main body tube 2 in the axial direction are provided in parallel in the axial direction, at a rear position close to the collar portion 1*d*, on the outer peripheral surface of the filling member 1, and protrusions 1*h* extending in an axial direction are respectively formed at four equal positions in the peripheral direction, in the position of the rear end portion. The protrusion 1*h* is provided for being engaged with the knurling 2*a* of the main body tube 2 in the rotating direction. Further, as shown in FIG. 17, an air vent groove 1*i* open to a rear side and extending short toward the leading end side is provided in an inner peripheral surface of the rear end portion of the filling member 1.

The filling member 1 is inside inserted to the main body tube 2 from a rear portion side thereof, a rear end surface of the collar portion 1*d* is brought into contact with an open end in a leading end side of the main body tube 2 as shown in FIGS. 1 and 2, the annular groove portion 1*g* and the annular protruding portion 1*f* are engaged with the annular protruding portion 2*b* of the main body tube 2, and the protrusion 1*h* is engaged with the knurling 2*a* of the main body tube 2, whereby the filling member 1 is attached to the main body tube 2 so as to be non-rotatable and immobile in the axial direction, and is integrally formed with the main body tube 2. Further, the cap 7 is attachable to the filling member 1 as shown in FIG. 1.

The filling member 1 is provided with the applying body 10 for applying the applying filler L in the leading end portion, as shown in FIGS. 1, 2 and 17. The applying body 10 is constituted by an elastic body made of a rubber material, an elastomer material or the like, and is provided with a curved disc-shaped applying portion 10*a* curved in such a manner that a portion near a center portion protrudes, and an annular attaching portion 10*b* continuously provided so as to protrude to a back surface in a peripheral edge side of the applying portion 10*a*, as shown in FIG. 17.

The applying portion 10*a* is provided with a discharge port 10*c* communicating an inner surface with an outer surface and formed for discharging the applying filler L, and the attaching portion 10*b* is provided with an annular groove portion 10*d* concaved to an axial side in an outer peripheral surface at a root position close to the applying portion 10*a*, as a structure engaging with the peripheral edge portion 1*j* forming the opening 1*c* of the filling member 1.

The applying body 10 is inside inserted to the opening 1*c* of the filling member 1 in such a manner that the attaching portion 10*b* is deflected to an axial side, and is structured, as shown in FIGS. 1 and 2, such that a rear end portion of the attaching portion 10*b* moves forward into the filling member 1 and the annular groove portion 10*d* is engaged with the peripheral edge portion 1*j* forming the opening 1*c* of the filling member 1, whereby the applying body 10 is attached to the filling member 1 so as not to be disengaged and is positioned in the opening 1*c*. The applying portion 10*a* of the applying body 10 is elastically deformed so as to be concaved to a rear side by being pressed to the applied portion, and is elastically restored to the original position by being moved apart from the applied portion.

In the case of assembling the applying filler extruding container 100 having the structure mentioned above, the main body side assembly 40 shown in FIG. 18 is obtained by mounting the click spring member 12 in the operating tube 3 so as to be received, screwing the thread tube 4 into the leading end portion of the movable body 6, attaching the elastic body 9 to the leading end of the movable body 6, coupling the movable body 6 having the elastic body 9 and the thread tube 4 to the shaft body 3*c* of the operating tube 3, and pressing and attaching the main body tube 2 to the assembly.

On the other hand, in the filling member 1, in a state in which the discharge port 10*c* of the applying body 10 is closed by a stop plug 13 so as to be reversed, a predetermined amount of applying filler L is filled in the filling region 1*x* so as to form no space within the leading end of the filling member 1. Further, the filling member 1 filled with the applying filler L is inserted to and attached to the leading end side of the main body side assembly 40. At this time, since an inner peripheral surface of the filling member 1 is set at an initial position while being in slidable contact with the annular protruding portion 9*g* for securing a water tightness of the elastic body 9, and the air vent groove 1*i* in the inner peripheral surface thereof is positioned so as to come across the annular protruding portion 9*g* in the axial direction, the air in the applying filler side is well vented to the rear side through the air vent groove 1*i*. Further, the stop plug 13 is detached finally. In this case, in place of the stop plug 13, a seal which can be detached after filling and just before the user uses and to which an adhesive agent is applied, may be attached to the discharge port 10*c* of the applying body 10 before the filling of the applying filler L.

In accordance with the applying filler extruding container 100 structured as mentioned above, since the filling member 1 filled with the applying filler L is structured such as to be inserted and attached to the leading end side of the main body side assembly 40, it is easy to assemble after filling the applying filler L in the filling member 1, and the applying filler L is in a state of being sufficiently (fully) filled in the filling region 1*x* between an inner side of the discharge port 10*c* of the applying body 10 constituting the leading end portion of the filling member 1 and the elastic body 9 attached to the leading end of the movable body 6 of the main body side assembly 40.

Next, a description will be given of a use of the applying filler extruding container 100 structured in the manner mentioned above. In the applying filler extruding container 100, if the main body tube 2 or the filling member 1 and the operating tube 3 are relatively rotated by a user, the movable body 6 moves forward and backward by the engaging mechanism and the rotation preventing mechanism mentioned above, and the leading end portion 3*f* of the protrusion 3*e* in the operating tube 3 constituting the click mechanism 11 mentioned above and the click tooth 12*a* of the click spring member 12 energized to the leading end portion 3*f* repeat the click engagement in accordance with the relative rotation at this time. Accordingly, the click feeling is given to the user, and a forward moving degree and a returning degree of the movable body 6 are detected on the basis of the click feeling.

Figure 19A:
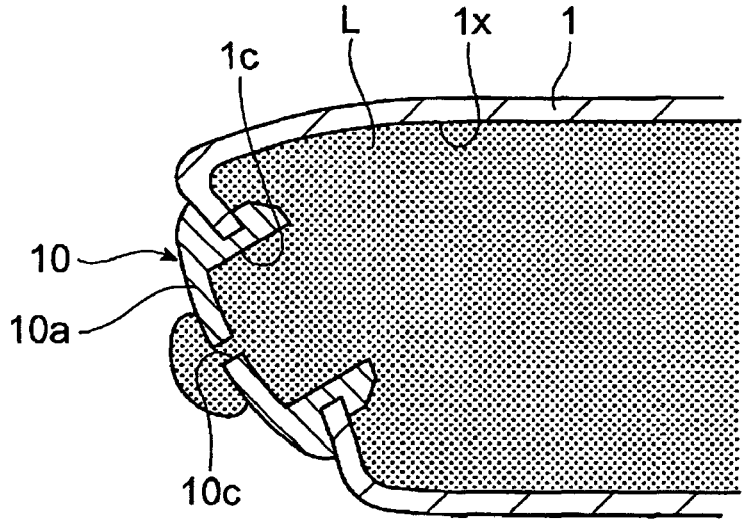
FIGS. 19(*a*), 19(*b*) and 19(*c*) are explanatory views showing a change of state of an applying body and the applying filler on the basis of use of the applying filler extruding container shown in FIGS. 1 and 2.
Figure 19B:
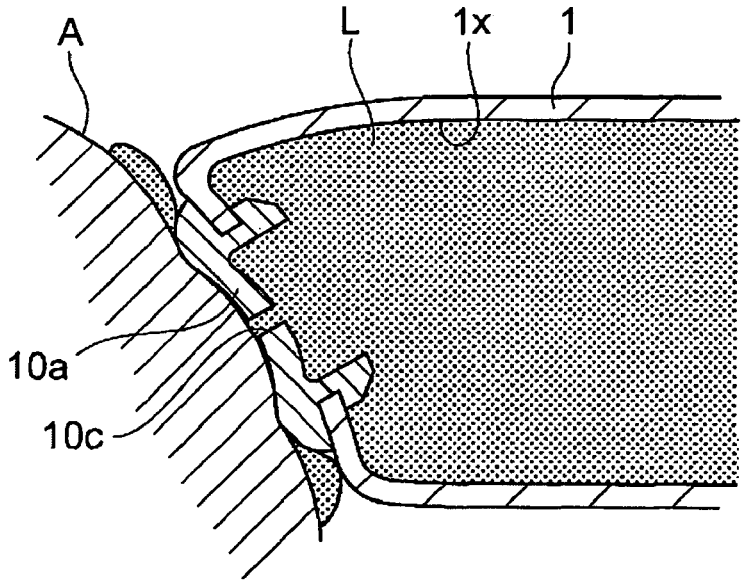
Figure 19C:
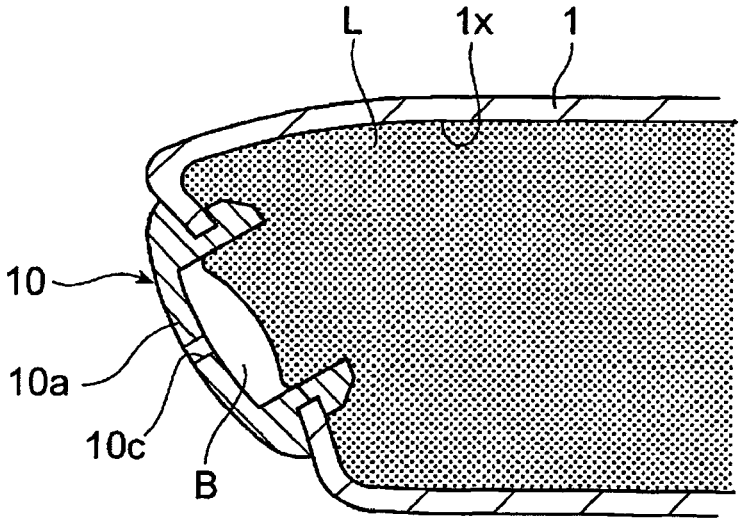
Figure 20:
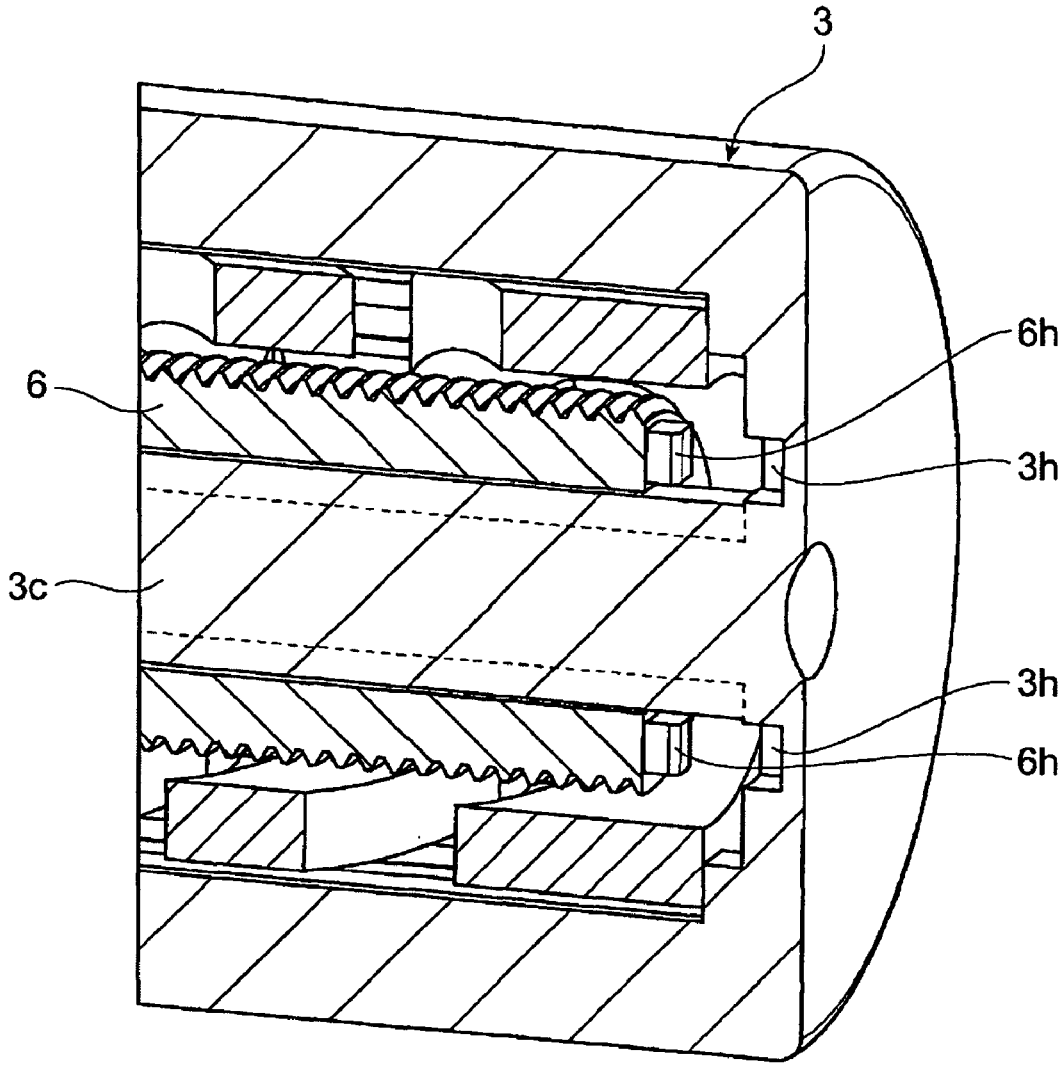
FIG. 20 is a longitudinal sectional perspective view of a rear end portion of the applying filler extruding container, to show another example of a shaft body wrench-off preventing mechanism in FIGS. 1 and 2.

Further, if the user relatively rotates the main body tube 2 or the filling member 1 and the operating tube 3 so as to move the movable body 6 forward while accompanying with the click feeling, at the first applying time after buying the applying filler extruding container 100, the applying filler L is rapidly (immediately) discharged from the discharge port 10*c* of the applying body 10 as shown in FIG. 19(*a*) without repeating the relative rotation more than necessary, because the applying filler L is sufficiently filled in the filling region 1*x* between the inner side of the discharge port 10*c* of the applying body 10 constituting the leading end portion of the filling member 1 and the elastic body 9 of the movable body 6 of the main body side assembly 40, as mentioned above. Accordingly, there is provided the applying filler extruding container 100 in which customer satisfaction is improved.

The user presses the applying portion 10*a* of the applying body 10 to the applied portion A so as to apply the applying filler L to the applied portion A in this state, as shown in FIG. 19(*b*). At this time, the applying portion 10*a* of the applying body 10 is elastically deformed so as to be concaved (collapsed) to the rear side on the basis of the pressing to the applied portion A. Since the applying portion 10*a* of the applying body 10 is elastically deformed as mentioned above, a feeling given to the applied portion A such as a skin or the like is soft and good. Further, since the applying portion 10*a* of the applying body 10 is pressed and collapsed, an internal pressure is increased, the applying filler L is discharged at a proper amount, and a use amount is secured.

Further, if the application is finished, and the applying body 10 is moved apart from the applied body A, the applying portion 10*a* of the applying body 10 is elastically restored to the original position (refer to FIG. 19(*a*)) as shown in FIG. 19(*c*). At this time, a predetermined space B is formed in an inner side including the discharge port 10*c* of the applying portion 10*a* in the applying body 10.

Accordingly, even if the applying filler L filled in the filling region 1*x* of the filling member 1 and the air mixing into the applying filler L is expanded due to variation of temperatures or variation of atmospheric pressure at a time of not being used such as a carrying time or the like, the applying filler L is prevented from leaking from the applying body 10 on the basis of the predetermined space B. Accordingly, it is possible to provide the applying filler extruding container 100 having an improved quality.

In this case, in the assembling procedure of the applying filler extruding container 100 described in FIG. 18, if the applying filler L of the filling region 1*x* is filled in a state in which the applying portion 10*a* of the applying body 10 is concaved, the applying portion 10*a* of the applying body 10 is elastically returned after the application so as to make the applying filler extruding container 100 in which the predetermined space B is formed upon filling of the applying filler L. Accordingly, the applying filler L is prevented from leaking from the applying body 10, since this time point, that is, since the time when the product is assembled.

Further, in accordance with the applying filler extruding container 100 on the basis of the present embodiment, as shown in FIG. 2, if the movable body 6 reaches the front to the maximum on the basis of the relative rotation between the main body tube 2 or the filling member 1 and the operating tube 3 by the user, the elastic body 9 is brought into contact with the rear end portion of the attaching portion 10*b* of the applying portion 10 attached to the leading end portion of the filling member 1, and is elastically deformed on the lines of the rear end portion inclined in the circular ring shape. At this time, the elastic body 9 is elastically deformed more preferably on the basis of the space 9*d* within the elastic body 9. Further, the applying filler L leaving in an approximately hoof-shaped (oblique circular cylindrical) space (a space including an inclined surface within the container leading end), which cannot be pressed out by the conventional movable body, is sufficiently pressed out with almost no remainder so as to be consumed, on the basis of the elastic deformation of the elastic body 9 mentioned above. Accordingly, there is provided an economic applying filler extruding container 100 in which a waste is reduced.

Further, in accordance with the applying filler extruding container 100, since the structure is made such that the annular groove portion 1*g* corresponding to the locking portion of the outer peripheral surface of the filling member 1 and the annular protruding portion 2*b* corresponding to the locking portion between the annular protruding portion 1*f* and the inner peripheral surface of the main body tube 2, and the protrusion 1*h* corresponding to the locking portion of the outer peripheral surface of the filling member 1 and the knurling 2*a* corresponding to the locking portion of the inner peripheral surface of the main body tube 2 are directly locked via no other member, it is possible to make the applying filler extruding container 100 thin. Accordingly, there is provided the applying filler extruding container 100 in which an appearance and a use feeling are improved.

Further, in accordance with the applying filler extruding container 100, the forward moving degree and the returning degree are detected by a user on the basis of the click feeling given to the user by the click mechanism 11. Accordingly, there is provided the applying filler extruding container 100 having an improved usability.

In this case, in the present embodiment, the movable body 6 moves backward, when the main body tube 2 or the filling member 1 and the operating tube 3 are relatively rotated in the other direction corresponding to the opposite direction to the one direction by a user with click feeling. Accordingly, if the relative rotating force intending to move further backward is given to the movable body 6 existing at the maximum retreated position by the user, there is a risk that the shaft body 3*c* engaging with the movable body 6 is wrenched off in the bottom surface of the operating tube 3. However, in the present embodiment, since a plurality of protruding portions 3*g* in the bottom surface of the operating tube 3 and a plurality of grooves 6*f* in the rear end surface of the movable body 6 are engaged in the rotating direction at the maximum backward moving time of the movable body 6, the rotating force intending to move the movable body 6 further backward and applied to the shaft body 3*c* is also applied to the protruding portion 3*g* of the operating tube 3 via the groove 6*f* of the movable body 6 so as to be dispersed, thereby preventing the shaft body 3 from being wrenched off. Accordingly, there is provided the applying filler extruding container 100 in which a quality is further improved.

In this case, the structure may be made such that concave portions are provided in place of the grooves 6*f* of the movable body 6 for preventing the shaft body 3*c* from being wrenched off, and the concave portions are engaged with the protruding portions 3*g* of the operating tube 3 in the rotating direction.

Further, as the other example of the shaft body wrench-off preventing mechanism, on the contrary of the shaft body wrench-off preventing mechanism mentioned above, as shown in FIG. 20, the structure may be made such that the convex portions 6*h* protruding to the rear side are provided at a plurality of positions along the peripheral direction in the rear end surface of the movable body 6, and a plurality of concave portions 3*h* which the convex portions 6*h* of the movable body 6 move forward into at the maximum retreated time of the movable body 6 and engage with in the rotating direction are provided in the peripheral edge of the shaft body 3*c* in the bottom surface of the operating tube 3.

Figure 21:
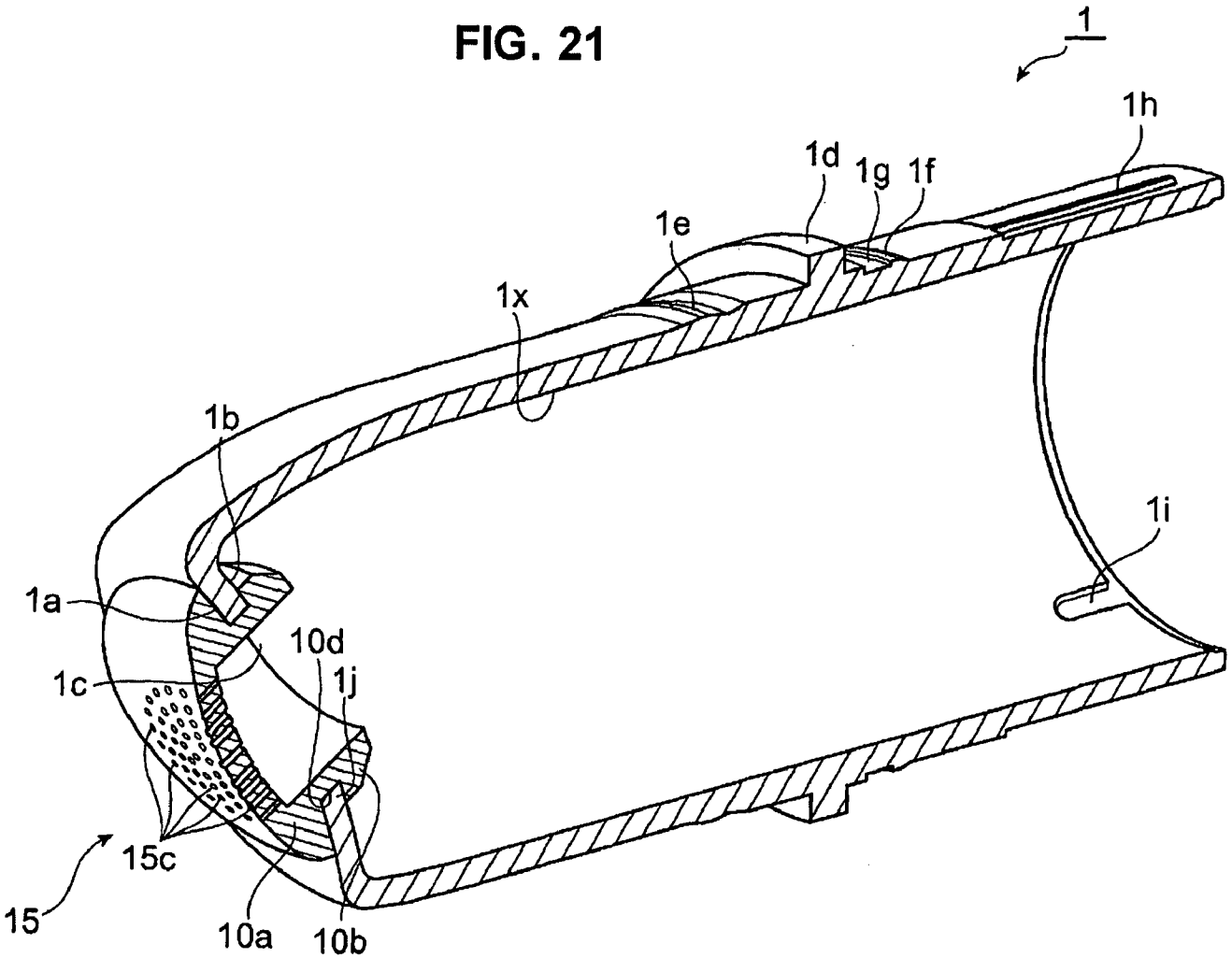
FIG. 21 is a perspective view showing another example of the applying body in FIG. 17.

Further, in place of the applying body 10 shown in FIG. 17, an applying body 15 having a plurality of discharge ports 15*c* for discharging the applying filler L may be used as shown in FIG. 21.

Figure 22A:
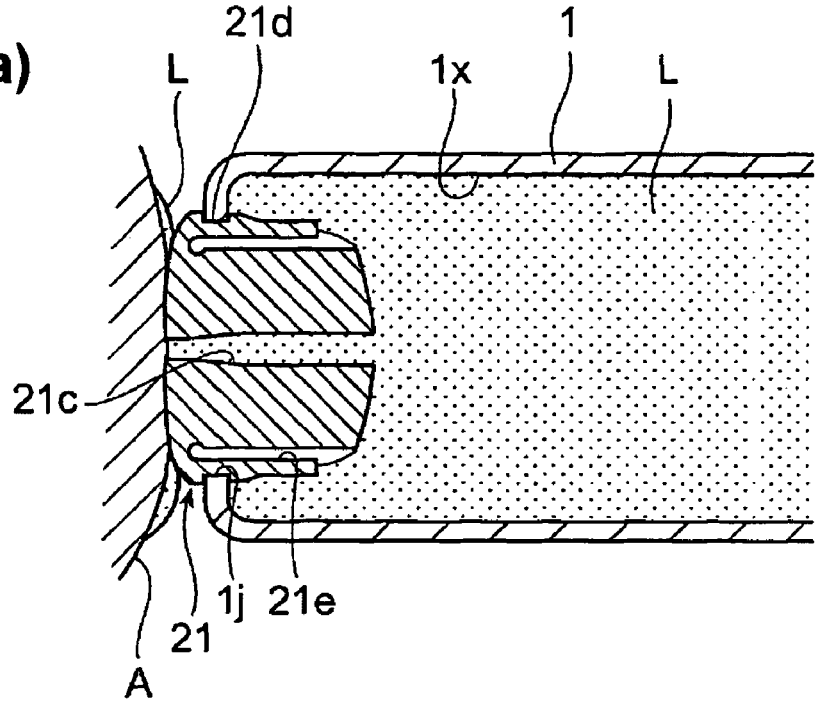
FIG. 22 is view showing further another example of the applying body in FIG. 17, with an explanation to show a change of state of the applying body and the applying filler on the basis of use.
Figure 22B:
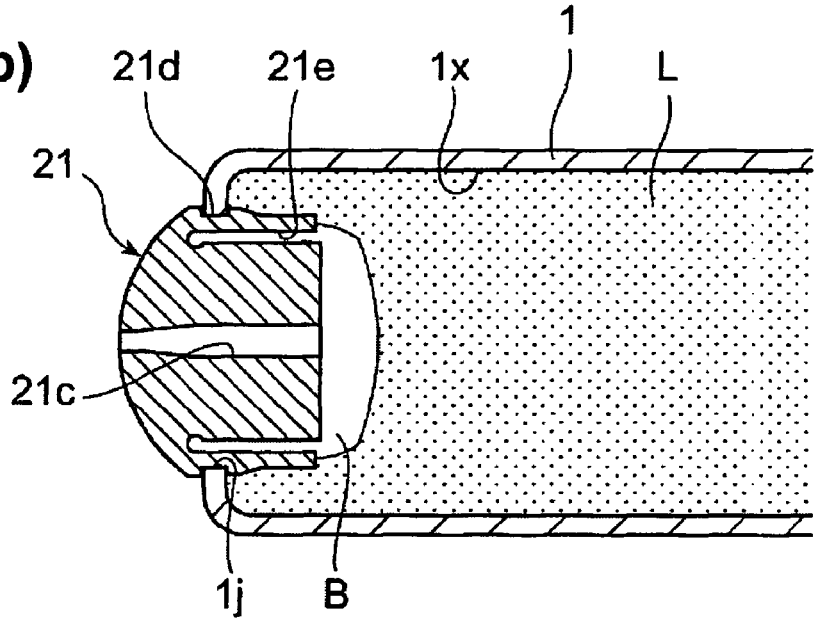

Further, an applying body 21 shown in FIG. 22 may be used in place of the applying body 10 shown in FIG. 17. The applying body 21 is formed in an approximately columnar shape, as shown in FIG. 22(*b*), and is structured such that a portion near a center portion of the leading end surface is curved so as to protrude. Further, a discharge port 21*c* for discharging the applying filler L is provided in the center thereof so as to pass through in an axial direction. Further, an annular groove portion 21*e* concaved at a predetermined length from a rear end surface to a leading end side is provided in a peripheral edge portion of a rear end surface of the applying body 21. The annular groove portion 21*e* is provided so as to deflect an outer portion from the annular groove portion 21*e* to an axial side so as to easily pressure insert, at a time of pressure inserting the applying body 21 to the opening of the filling member 1. Further, the annular groove portion 21*d* concaved to the axial side is provided as a structure engaging with the peripheral edge portion 1*j* forming the opening of the filling member 1, in an outer peripheral surface of the applying body 21.

Further, the applying body 21 is pressure inserted to the opening of the filling member 1, and the annular groove portion 21*d* thereof is engaged with the peripheral edge portion 1*j* forming the opening of the filling member 1, thereby being attached to the filling member 1 so as not to be disconnected, and being structured such as to be positioned in the opening of the filling member 1.

The applying body 21 is elastically deformed in such a manner as to be concaved to a rear side by being pressed to the applied portion A at a time of application, as shown in FIG. 22(*a*), and is elastically restored to the original position at a time of being apart from the applied portion A. As shown in FIG. 22(*b*), a predetermined space B is formed in an inner side (a rear side) of the applying body 21 after application. Accordingly, it is possible to obtain the same effect as that of the applying filler extruding container 100 as mentioned above. In this case, in the embodiment shown in FIG. 22, the leading end surface having the opening 1*c* of the filling member 1 is formed as a surface which is vertical to the axial direction.

Figure 23:
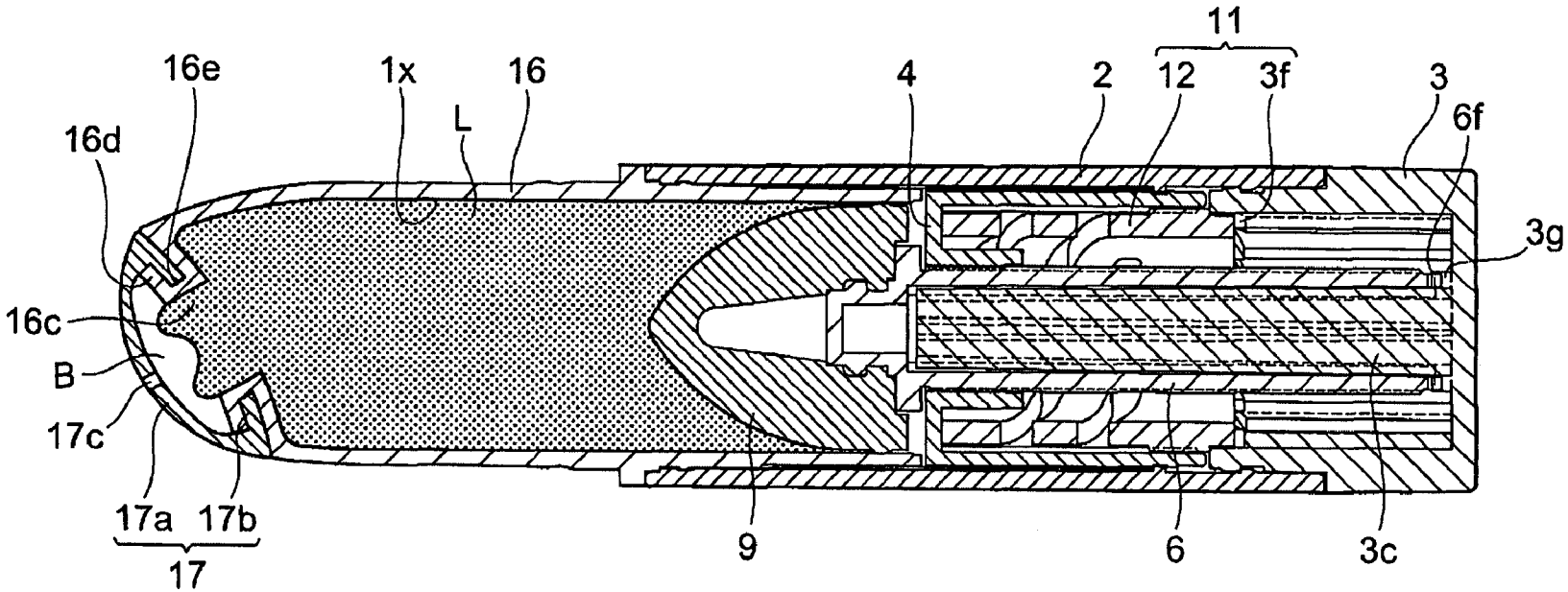
FIG. 23 is a longitudinal sectional view of the applying filler extruding container showing further another example of the filling member and the applying body shown in FIG. 17.

Further, a filling member 16 and an applying body 17 shown in FIG. 23 may be used. The filling member 16 is different from the filling member 1 in a point that the peripheral edge portion forming an opening 16*c* for discharging the applying filler L is structured such as to have an annular fold-back portion 16*d* folded back to an outer side, and a bag-shaped annular groove portion 16*e* for engaging the applying body 17 is formed by the annular fold-back portion 16*d*. Further, the applying body 17 is different from the applying body 10 in a point that an annular attaching portion 17*b* protruding to an axial side and a rear side is provided in a peripheral edge portion of a curved disc-shaped applying portion 17*a* having a discharge port 17*c* and curved to an outer side.

Further, the applying body 17 is structured such that an attaching portion 17*b* moves forward to the annular groove portion 16*e* of the filling member 16 so as to be engaged, thereby being attached to the filling member 16 so as not to be disconnected, and an applying portion 17*a* covers the opening 16*c* of the filling member 16. Even in the case that the filling member 16 and the applying body 17 are employed, the same operations and effects as those of the applying filler extruding container 100 mentioned above can be achieved.

Figure 24:
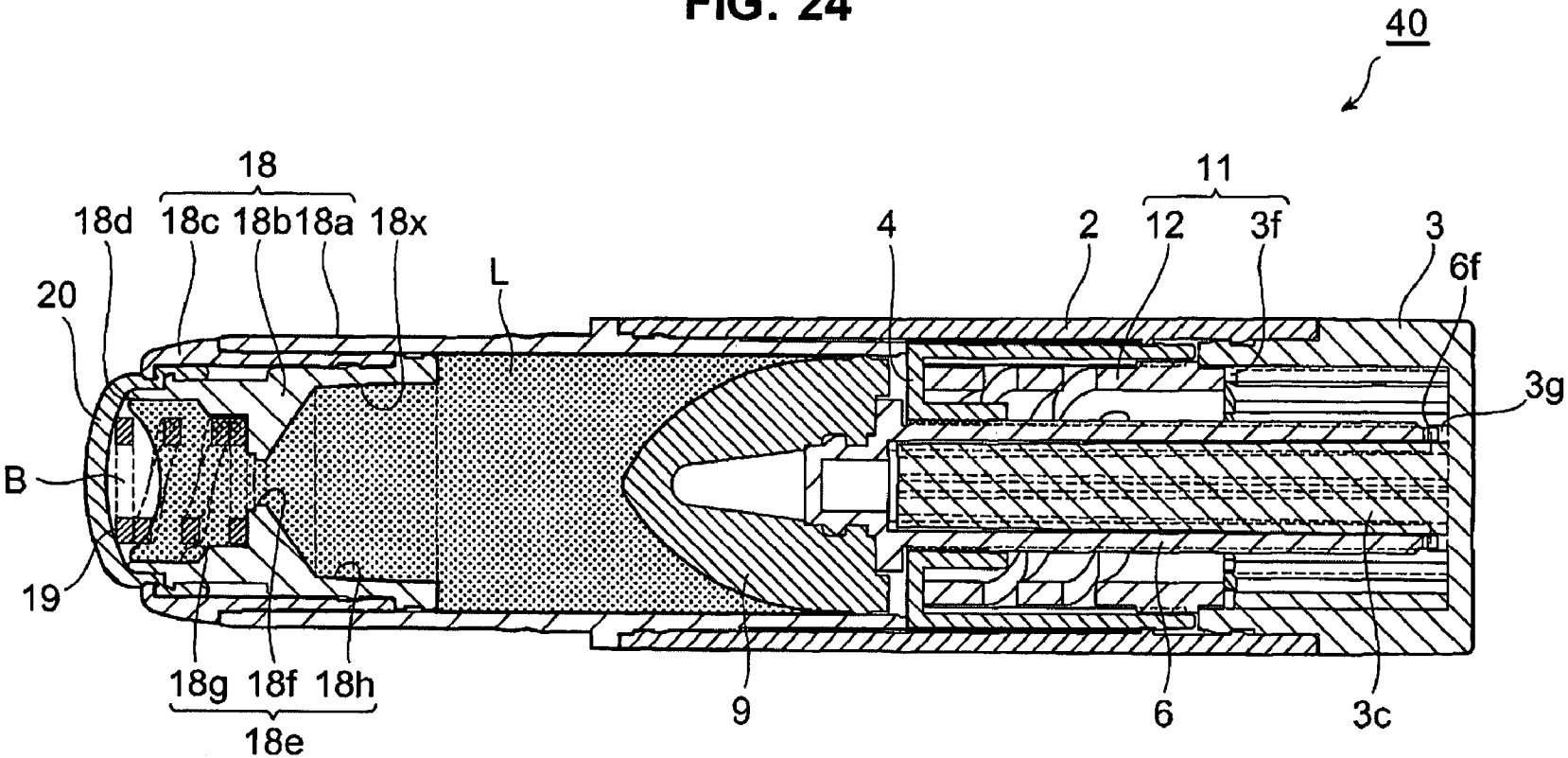
FIG. 24 is a longitudinal sectional view of the applying filler extruding container showing further another example of the filling member and the applying body shown in FIG. 17.
Figure 25:
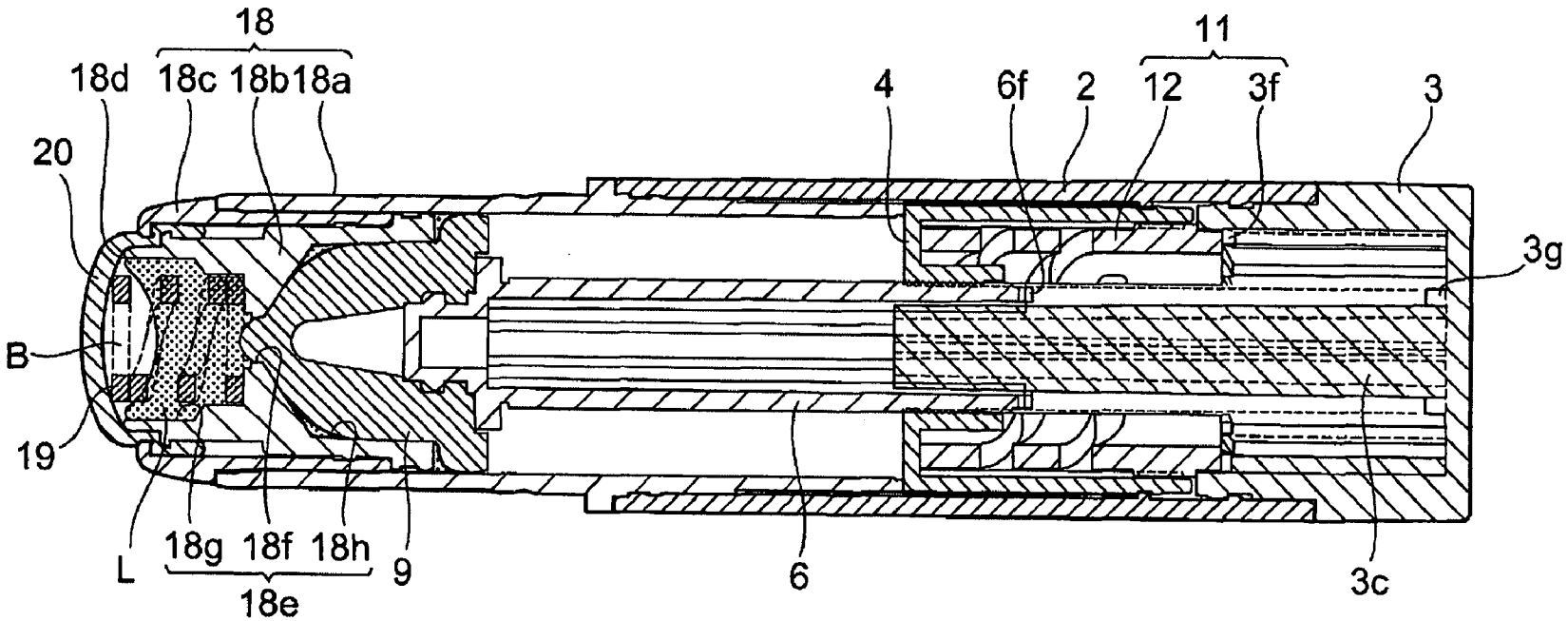
FIG. 25 is a view showing a state that the movable body of the applying filler extruding container shown in FIG. 24 is at a maximum forward moving time.
Figure 26:
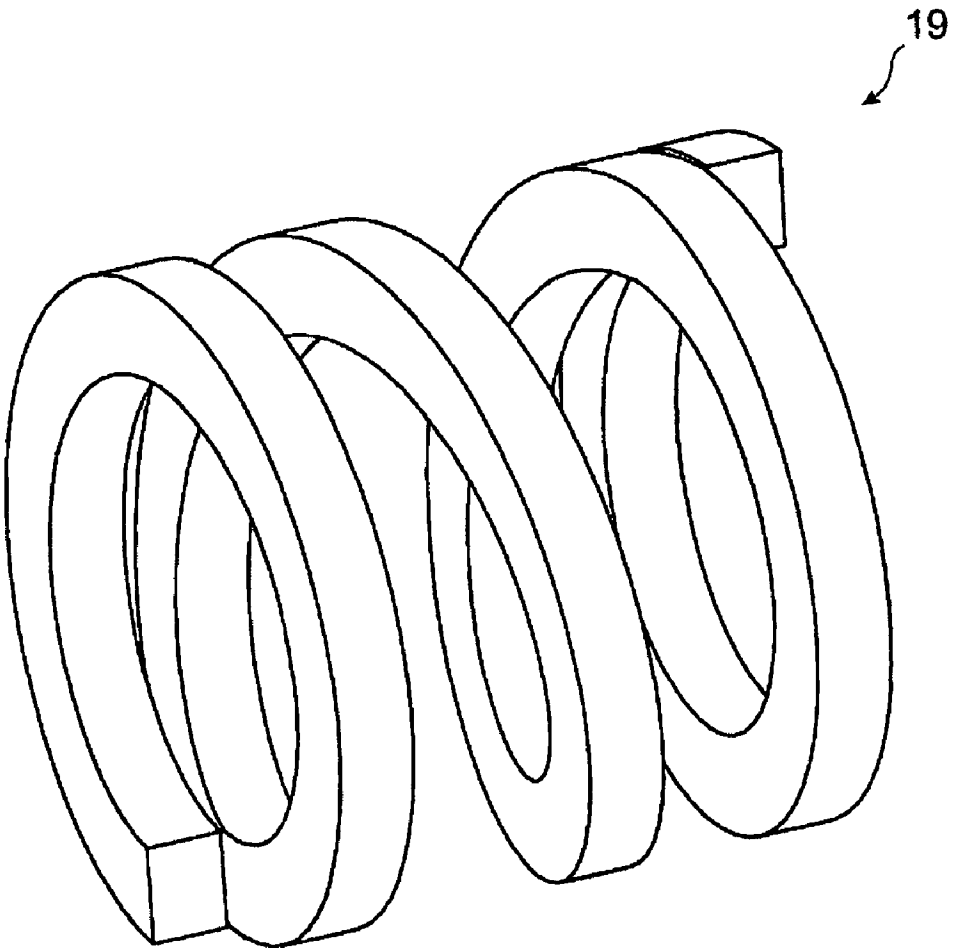
FIG. 26 is a perspective view showing an elastic body within the container in FIGS. 24 and 25.

Further, as shown in FIGS. 24 to 26, the structure may be made such that the applying body 20 is elastically restored by an elastic body 19 within a filling member 18 constituting the container.

The filling member 18 is provided with a filling member main body 18*a* coupled to the main body tube 2 so as to be non-rotatable, and immobile in the axial direction, a filling member leading end portion 18*b* attached to a leading end portion of the filling member main body 18*a*, and an applying body holding portion 18*c* attached to the filling member leading end portion 18*b* and holding the applying body 20, and is entirely formed in an approximately cylindrical shape.

The filling member main body 18*a* receives most of the applying filler L to be filled. The filling member leading end portion 18*b* is structured such that a leading end surface having an opening 18*d* for discharging the applying filler L is formed as a surface vertical to the axial direction, and is provided with a discharge passage 18*e* communicating from the opening 18*d* in the leading end surface to a rear end surface. The discharge passage 18*e* is structured such that an approximately center portion in the axial direction is formed as a small-diameter narrow passage 18*f*, and a front side and a rear side of the narrow passage 18*f* are formed as large-diameter expanded passages 18*g* and 18*h*.

The applying body 20 is constituted by an elastic body made of a porous material, for example, an urethane foam, a fine net-like material or the like, and is formed in a curved disc shape curved to an outer side. A peripheral edge portion bent to a rear side in the applying body 20 is engaged with a leading end portion of the filling member leading end portion 18*b* and engaged with a leading end portion of the applying body holding portion 18*c* so as to be pressed, whereby the applying body 20 is attached to the filling member 18, and covers the opening 18*d* of the filling member 18.

Further, a compression spring 19 serving as the elastic body is arranged in a front side expanded passage 18*g* of the filling member leading end portion 18*b*. The compression spring 19 is arranged so as to be pinched between a back surface of the applying body 20 and a peripheral edge portion of the narrow passage 18*f* of the filling member leading end portion 18*b*, and is structured such as to always energize the applying body 20 to the outer side.

Further, since the applying filler extruding container having the structure mentioned above is structured such that the filling member 18 in which the applying filler L is filled is inserted and attached to the leading end side of the main body side assembly 40, it is easy to assemble after the applying filler L is filled in the filling member 18, and there is provided a state in which the applying filler L is sufficiently filled in a filling region 18*x* between an inner side of the applying body 20 constituting the leading end portion of the filling member 18, and the elastic body 9 attached to the leading end of the movable body 6 of the main body side assembly 40.

Accordingly, in the applying filler extruding container, in the case that the user relatively rotates the main body tube 2 or the filling member 18 and the operating tube 3 while accompanying the click feeling so as to move forward the movable body 6 at the first applying time after buying the applying filler extruding container, the applying filler L is rapidly discharged from the porous portion functioning as a discharge port of the applying body 20 without repeating the relative rotation more than necessary, because the applying filler L is sufficiently filled in the filling region 18*x*.

Further, when pressing the applying body 20 to the applied portion A and applying the applying filler L to the applied portion A in the same manner as described in FIG. 19(*b*) under the state in which the applying filler L is discharged as mentioned above, the applying body 20 is elastically deformed so as to be concaved to the rear side against the energizing force of the compression spring 19 on the basis of the pressing to the applied portion A. When the application is finished and the applying body 20 is moved apart from the applied portion A, the applying body 20 is elastically restored to the original position shown in FIG. 25 on the basis of the energizing force of the compression spring 19. The predetermined space B is formed in the inner side of the applying body 20 at this time. Accordingly, even if the applying filler L filled in the filling member 18 and the air mixing into the applying filler L are inflated due to the variation of temperature and the variation of atmospheric pressure, the applying filler L is prevented from leaking from the applying body 20 on the basis of the predetermined space B.

In this case, in the same manner as the case of the applying filler extruding container 100 mentioned above, if the applying filler L is filled in a state in which the applying body 20 is concaved, the applying body 20 is elastically returned on the basis of the energizing force of the compression spring 19 after the application so as to make the applying filler extruding container in which the predetermined space B is formed upon filling of the applying filler L. Accordingly, the applying filler L is prevented from leaking from the applying body 20, since this time point, that is, since the time when the product is assembled.

Further, as shown in FIG. 25, if the movable body 6 moves forward to the maximum on the basis of the relative rotation between the main body tube 2 or the filling member 18 and the operating tube 3 by the user, the elastic body 9 is brought into contact with the inclined surface in the leading end side of the rear side expanded path 18*h* so as to be elastically deformed, and the leading end portion of the elastic body 9 bulges so as to move forward to the front side expanded passage 18*g* through the narrow passage 18*f*. Accordingly, the applying filler L is well pressed out so as to be consumed. In this case, the other operations and effects are the same as those of the applying filler extruding container 100 mentioned above.

The description is particularly given above of the present invention on the basis of the embodiments, however, the present invention is not limited to the embodiments mentioned above, but a cilia or the like may be planted on the outer surfaces of the applied bodies 10, 15, 17, 20 and 21 or a brush formed by bundling tapered polyester fibers may be attached.

In this case, the male threads 6*b* include intermittently arranged projection groups or spirally and intermittently arranged projection groups which have the same function as the thread ridge. Further, the female threads 4*c* include intermittently arranged projection groups, or spirally and intermittently arranged projection groups which have the same function as the thread ridge.

What is claimed is:

1. An applying filler extruding container capable of extruding an applying filler filled in a filling region within a container to a leading end side on the basis of forward movement of a movable body arranged within the container, the container comprising:

an operating tube structured as a closed-end tube that constitutes a rear portion of the container and that further comprises a protruding portion extending in an axial direction from the bottom of the operating tube, wherein the protruding portion further comprises an engagement portion;

a main body tube structured such as to be relatively rotatable at a leading end side of the operating tube;

a tubular body arranged so as to be non-rotatable around an axial line and immovable in an axial direction and having a female thread in an inner circumference thereof;

a movable body having a male thread on an outer circumference thereof that engages with the female thread in an inner circumference of the tubular body and that further comprises an engagement portion that engages with the engagement portion of the protruding portion of the operating tube so as to be non-rotatable around an axial line and movable in an axial direction, wherein the engagement portion of the protruding portion and the engagement portion of the movable body combine to form a rotation preventing portion;

a click spring member structured in a tubular shape and comprising a click tooth and a compression spring portion arranged in such a manner that the movable body passes through an inner side of the click spring member and the click spring member is pinched between the tubular body and an inner portion of the operating tube, thereby forming a click mechanism; and a leading tube that is closed at one end by a leading end side applying surface and defines a filling region on the inner portion of the leading tube, the leading end side applying surface comprising a discharge port having a diameter that is smaller than the filling region and wherein the lead tube and the leading end side applying surface combine to form a filling member where liquid filler is filled;

wherein the movable body moves forward or backward by a thread engagement portion, the thread engagement portion comprising the female thread of the tubular body and the male thread of the of the movable body, when the operating tube and the main body tube are relatively rotated in one direction or in the other direction corresponding to an opposite direction to the one direction and a click feeling is given by the click mechanism when the operating tube and main body are rotated; and wherein the filling member is inserted into the leading end side of the main body tube.

2. The applying filler extruding container as claimed in claim 1, wherein the click spring member is arranged in such a manner that the click tooth is directed to a bottom portion side of the operating tube, and a predetermined engagement portion engaging with the click tooth is provided in an inner portion of the operating tube.

3. The applying filler extruding container as claimed in claim 1 or claim 2, wherein the click tooth is structured in a chevron shape having an upward incline and downward incline along a circumferential direction.

* * * * *